US005263914A

United States Patent [19]

Simonson et al.

[11] Patent Number: 5,263,914

[45] Date of Patent: Nov. 23, 1993

[54] WEIGHT MACHINE

[75] Inventors: Roy R. Simonson, Davis; Craig R. Thompson, Rancho Cordova; Glen R. Mangseth, El Dorado Hill, all of Calif.

[73] Assignee: Loredan Biomedical, Inc., West Sacramento, Calif.

[21] Appl. No.: 669,734

[22] Filed: Mar. 15, 1991

Related U.S. Application Data

[63] Continuation-in-part of Ser. No. 641,142, Jan. 11, 1991, abandoned, which is a continuation-in-part of Ser. No. 600,420, Oct. 19, 1990, abandoned, which is a continuation-in-part of Ser. No. 504,177, Apr. 4, 1990, abandoned.

[51] Int. Cl.[5] ..... A63B 21/062

[52] U.S. Cl. ..... 482/99; 482/100; 482/137

[58] Field of Search ..... 482/93-94, 482/97-103, 133-138, 142

[56] References Cited

U.S. PATENT DOCUMENTS

| | | | |
|---|---|---|---|
| 3,116,062 | 12/1963 | Zinkin | 482/137 X |
| 3,917,262 | 11/1975 | Salkeld | 482/137 X |
| 4,149,714 | 4/1979 | Lambert, Jr. | 482/100 |
| 4,200,279 | 4/1980 | Lambert, Jr. | 482/100 |
| 4,227,689 | 10/1980 | Keiser | 482/137 X |
| 4,256,302 | 3/1981 | Keiser et al. | 482/137 X |
| 4,322,071 | 3/1982 | Lambert, Jr. et al. | 482/100 |
| 4,339,125 | 7/1982 | Uyeda et al. | 482/98 |
| 4,354,675 | 10/1982 | Barclay et al. | 482/99 X |
| 4,358,108 | 11/1982 | Voris | 482/98 |
| 4,422,636 | 12/1983 | De Angeli | 482/99 X |
| 4,426,077 | 1/1984 | Becker | 482/102 |
| 4,509,745 | 4/1985 | Angsten | 482/98 |
| 4,614,338 | 9/1986 | Castillo | 482/99 X |
| 4,621,807 | 11/1986 | Stramer | 482/100 |
| 4,809,972 | 3/1989 | Rasmussen et al. | 482/99 |
| 4,834,396 | 5/1989 | Schnell | 482/97 |
| 4,838,548 | 6/1989 | Maag | 482/137 X |
| 4,842,270 | 6/1989 | Lange | 482/101 |
| 4,890,830 | 1/1990 | Kern | 482/98 |
| 4,902,006 | 2/1990 | Stallings, Jr. | 482/99 |
| 4,964,632 | 10/1990 | Rockwell | 482/100 |
| 4,971,305 | 11/1990 | Rennex | 482/93 |

FOREIGN PATENT DOCUMENTS

| | | | |
|---|---|---|---|
| 240087 | 10/1978 | European Pat. Off. | 482/99 |
| 2612406 | 9/1988 | France | 482/100 |
| 635999 | 12/1978 | U.S.S.R. | 482/137 |

*Primary Examiner*—Robert Bahr

*Attorney, Agent, or Firm*—Townsend and Townsend Khourie and Crew

[57] ABSTRACT

A first end of a lever pivots about a fixed axis as a second end is raised and lowered by the user. A carriage is disposed on the lever and is designed to travel the length of the lever between the first and second ends. A belt is coupled to a weight and to the carriage through a series of pulleys. The lever is shaped so that the weight neither raises nor lowers as the carriage travels from one end of the lever to the other. The distance that the weight travels in response to movement of the second end is thus proportional to the position of the carriage on the lever. By moving the carriage to numerous positions between the first and second ends of the lever, the torque needed to lift the weight and the distance by which the weight moves may be varied correspondingly in numerous increments over a very large range. A number of different user interfaces may be coupled to the lever for creating an equal number of different weight training machines.

20 Claims, 23 Drawing Sheets

WEIGHT MACHINE

This is a continuation-in-part of copending application Ser. No. 07/641,142, filed Jan. 11, 1991, now abandoned, which is a continuation-in-part of copending application Ser. No. 07/600,420, filed Oct. 19, 1990, now abandoned, which is a continuation-in-part of copending application Ser. No. 07/504,177, filed Apr. 4, 1990 now abandoned.

BACKGROUND OF THE INVENTION

This invention relates to exercise and rehabilitation devices and, more particularly, to weight training machines.

A typical weight machine comprises a stack of weight plates which travel along guide bars and which are coupled to a lifting mechanism which translates a user's exercise movements to raising the stack from a resting, unloaded position and then lowering the stack back down to the unloaded position. The user typically moves a selected plurality of the weight plates over a fixed distance, and the resistance to the user's exercise movements created by the weight plates is used to strengthen specific muscle groups. The user must change the number or size of weight plates coupled to the lifting mechanism in order to vary the amount of resistance to a given movement by the user. That is, the user must increase the number or size of weight plates to increase resistance to a given movement, and vice versa. The range of travel for a given amount of weight does not vary with the amount of weight selected.

Known weight training machines have many disadvantages. First, high speed training is hampered by inertial "fly away" effects of the weights, especially at low weight selections. The fly away effects of the weights create irritating noise and nonuniform resistance. The nonuniform resistance results from the fact that the effective resistance that the weights exert against the user's movement varies as the velocity of the weights varies. Many exercises are most efficient to develop particular types of strength if the user moves quickly from his or her initial position to the fully flexed or extended position. In such exercises the velocity of the user's movement and, therefore, the velocity of the weights may change significantly during a single movement. Because the kinetic energy of the weights is proportional to the square of their velocity, the resistance of the weight to the user's movement may vary over a wide range. Indeed, resistance may be zero if the weights become airborne during the movement. Second, the available weight increments are determined by the size of the individual weight plates which make up the weight stack. If small weight increments are desired, then numerous small weight plates must be used to accommodate stronger users, and this results in a very large weight stack. On the other hand, if large weight increments are desired, then large weight plates must be used, and all users must cope with large increment values. Third, a substantial amount of friction results when the weight plates travel along and rub against the guide bars, and the friction interferes with mid-motion stops and starts. Fourth, known weight machines cannot by their nature accommodate zero-resistance or very low load exercises since they do not provide for counterbalancing of the lifting mechanism.

SUMMARY OF THE INVENTION

The present invention is directed to a weight or other resistance training machine which eliminates many problems which arise in conventional machines. For example, excessive friction and inertial "fly away" effects encountered with traditional weight training machines are greatly reduced, thus allowing mid-motion stops and starts and making high speed training desirable. Resistance may be varied in numerous small selectable increments over a very large range, and a counterbalancing feature of the mechanism allows users to train at zero or very small resistance.

A weight machine of the invention employs a lever between the user and a weight or other suitable source of resistance. This permits the user to vary the amount of resistance by changing the distance the weight moves in response to a given distance of movement by the user. The weight machine of the invention employs, in its preferred form, a single weight or weight stack coupled to the lever, and it permits the user, by adjusting the lever, to change the amount of resistance without changing the amount of weight. The invention also permits the user to select virtually an unlimited number of increments of effective "weight" from that single weight. The employment, in this preferred form, of a single weight permits the user to do high speed training against small effective resistance by moving a substantially heavier weight over a small distance. This substantially reduces the variation in the velocity of the weight during an exercise, and it reduces the undesirable variation in resistance that accompany changes in inertia. By reducing the number of discrete weights, and in the preferred form employing a single weight, the machine of the invention reduces the number of friction creating surfaces between the guide (when used) and the weights, or weight. The weight machine of the invention permits the user, through appropriate adjustment of the lever and without changing the number or size of weights, to reduce the effective resistance to very low levels and to zero effective resistance (or even positive assistance), by employing the weight to counterbalance the weight of other parts of the machine. These and other benefits are achieved by the weight machine of the invention.

In a basic embodiment of the present invention, a first end of a lever pivots about a fixed axis as a second end is raised and lowered by the user. A carriage is stably supported on the lever by multiple rollers and is designed to travel the length of the lever between the first end and the second end. The carriage is adapted to be fixed at substantially any number of locations along the lever, the number of locations depending only upon the type of devices employed to fix the location of the carriage. In a basic embodiment, the carriage is adapted to be fixed for one hundred or more locations corresponding to one hundred or more resistance increments from substantially zero effective weight to substantially the maximum effective weight. The carriage may be fixed at a desired location along the lever by a suitable device. It is preferred that the lever has a plurality of apertures disposed between the first and second ends, and the carriage includes one or more pins which removably extend into one or more apertures in the lever for fixing the carriage at a desired location along the lever. Although the pins are sufficient to maintain the carriage in place on the lever, a preferred embodiment of the carriage employs milled pins each having an abutment which contacts an abutment in a corresponding lever aperture. This arrangement essentially locks the pins in place so that the pins cannot be inadvertently or maliciously disengaged from the lever as the user is exercising.

A belt or some other elongated, flexible, and nonextensible member is coupled to a vertically suspended dead weight (e.g, a conventional stack of weights or to a single weight) and to the carriage through a series of guides (e.g., pulleys). The weight thus moves in a vertical plane for eliminating horizontal inertial forces that may cause the weight training machine to "walk" or vibrate in an undesirable manner. The lever is shaped so that when the lever is in the resting position, the weight or weights neither raises nor lowers as the user moves the carriage from one end of the lever to the other. The distance that the weights or weight travels in response to movement of the second end is thus proportional to the position or location of the carriage on the lever. By adjusting the carriage to numerous different positions between the first and second ends of the lever and aligning the carriage with weight-indicating markings on the lever, the force needed to lift the weights or weight and the distance by which the weights or weight moves may be varied correspondingly in numerous increments over a very large range. When the carriage is located near the pivot point at the first end, weight resistance is relatively low and the weight travels a very small distance, thus providing very little inertia and fly away effects. The carriage is designed to travel to and beyond the pivot axis so that the force applied to the lever by the weight may change direction. This provides a counterbalancing mechanism which allows users to train at zero resistance, or even with positive assistance. The effective amount of weight corresponding to various locations of the carriage along the lever may be shown on the lever in a manner that permits the weight values to be visible to the user, preferably when the user is in the exercise position.

The basic weight machine may be coupled to various linkage mechanisms to provide numerous weight training machines. In general, the user exerts force on a user interface that is coupled to a rigid linkage mechanism which translates the user's motion to compressive motion at a location off to the side of the user. The basic weight machine is coupled through a four-bar linkage at that location.

When used in this manner, other advantages of the present invention include increased ease of use of the weight selection mechanism since the user merely moves a readily accessible handle or knob that is located off to the side of the user. This may be done from the exercise position, and thus the weight resistance may be changed more frequently without significantly interrupting the exercise session and with less susceptibility to injury. The numerous resistance increments allows all users to better match their ability to the amount of resistance. The lever principle allows a single large weight or weight stack to be used for all training needs. This reduces the space needed to store "extra" weights, eliminates the noise of multiple weights banging together and reduces friction if the weight is designed to travel along a guide (since there would be at most one or two contact points with the guide). By reducing the distance that the weight travels in response to the user's movement, variations in the velocity of the weight throughout the user's range of motion are minimized or eliminated, so the actual force required to move the weight throughout the user's range of motion closely tracks the designed force curve. This, in turn, increases the effectiveness of the exercise and reduces the chance of injury.

The arrangement of guides, and preferably pulleys, between the weight and the carriage may be designed so that the force applied by the user is the same as the force applied at the second end of the lever. A single 400 pound weight may be employed in a particular machine designed for a particular exercise. If a user wishes to exercise slowly against that 400 pound resistance, the user may select the location along the lever that translates a two foot movement by the use into a two foot upward movement of the weight. If the user wishes to do the same exercise at high speed with 40 pounds resistance to develop power, the user may adjust the location of the carriage so that a two foot movement by the user translates into a 2.4 inch movement by the weight. The variation of the velocity of the weight over that 2.4 inch distance are substantially smaller than those variations would have been if the user had moved a 40 pound weight over a two foot distance in the same time.

DETAILED DESCRIPTION OF THE PREFERRED EMBODIMENTS WEIGHT LIFTING MACHINE OVERVIEW

Figure 1:
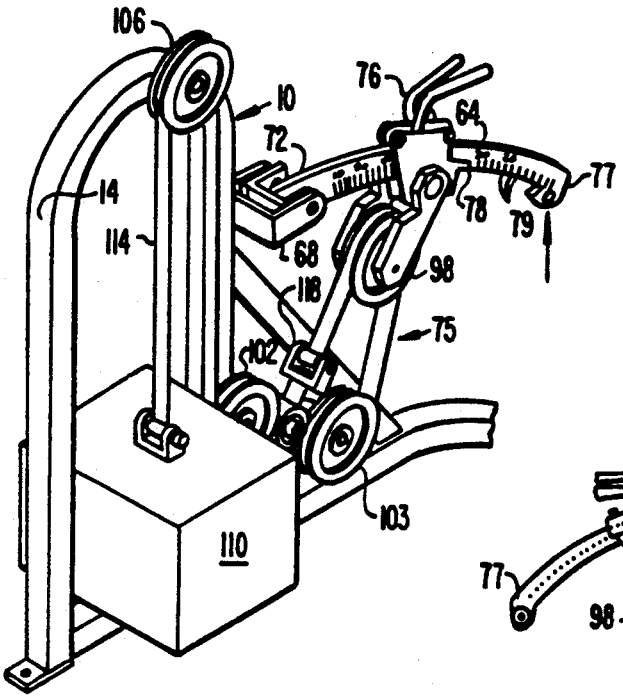
FIG. 1 is a right side perspective view of a particular embodiment of a weight lifting machine according to the present invention.
Figure 2:
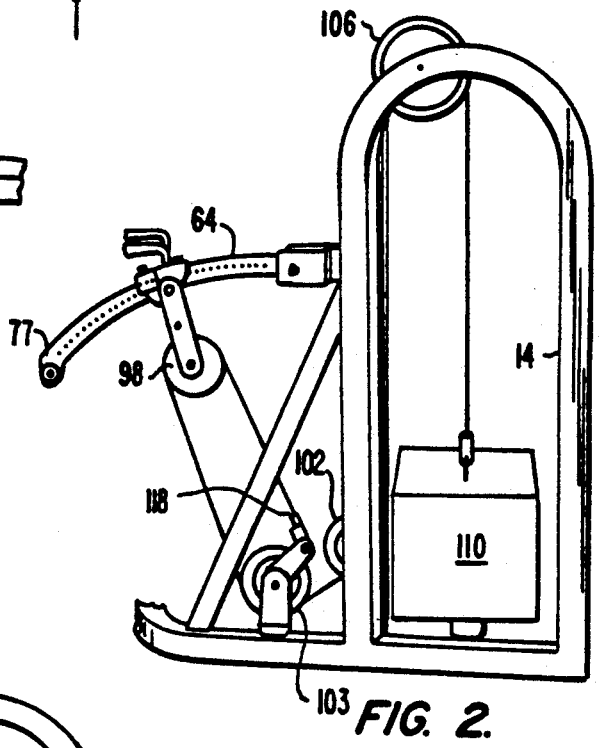
FIG. 2 is a left side perspective view of the weight lifting machine shown in FIG. 1.
Figure 3:
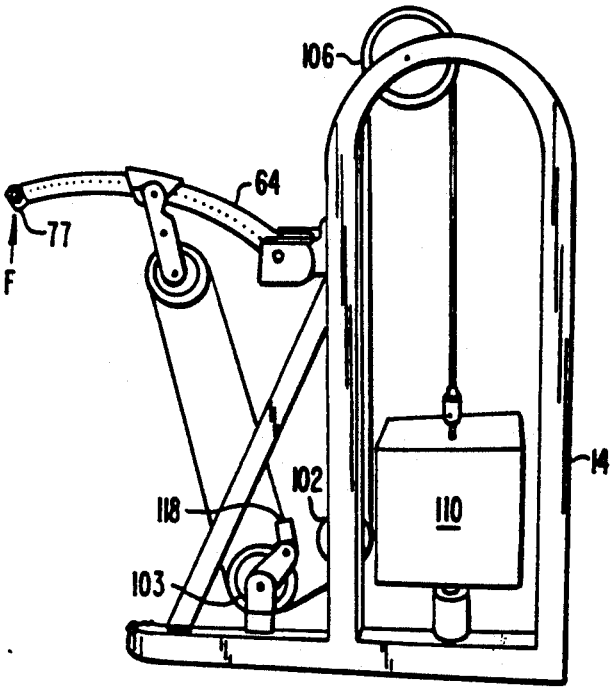
FIG. 3 is another left side perspective view of the weight lifting machine shown in FIG. 1 showing the weight lifted.

FIGS. 1-3 are perspective views of a particular embodiment of a weight lifting machine 10 according to the present invention. Weight machine 10 includes a frame 14 which may or may not be part of a larger frame structure. Coupled to frame 14 is a lever or other pivoting member 64 having a moveable carriage 76 disposed thereon. Carriage 76 is coupled to a resistance element such as one or more weights 110 by a kevlar reinforced belt 114 which passes through one or more guides such as a pulley arrangement 75. In this embodiment, weight 110 is suspended for movement in a vertical plane. Of course, weight 110 could be replaced by a spring, a hydraulic cylinder, or some other resistance element. Furthermore, as used herein, the term "belt" refers to any kind of elongated, flexible and generally nonextensible member and it may also comprise a cable, a chain, a rope, etc., and it may be formed of metal, rubber, fabric, or some other material. One end 72 of lever 64 is coupled to frame 14 through a flange 68 (FIG. 7) and pivots about an axis P as another end 77 is raised and lowered by the user. Carriage 76 is designed to travel the length of lever 64, and it includes a pointer 78 which is used in conjunction with weight indicating markings 79 on lever 64 to select the desired weight or resistance value at which the user desires to train. Markings 79 preferably translate the forces exerted on carriage 76 at the various locations along the lever into actual weight values.

Pulley arrangement 75 comprises a pulley 98 rotatably attached to pulley support bars 99 and 100 extending from carriage 76, pulleys 102 and 103 rotatably attached to a lower portion of frame 14, and a pulley 106 rotatably attached to an upper portion of frame 14. Belt 114 passes around pulley 106 for suspending weight 110 therefrom. Belt 114 also passes around pulleys 102, 103 and 98, and it is affixed to frame 14 by a coupling 118 adjacent to pulley 103.

Lever 64 is shaped and coupling 118 is located on frame 14 so that weight 110 neither raises nor lowers as the carriage travels from one end of the lever to the other when lever 64 is in the initial position shown in FIGS. 1 and 2. In this embodiment, this is accomplished by forming lever 64 as a circularly arcuate bar having a constant radius of curvature relative to pulley 103.

As shown in FIG. 3, weight 110 moves upwardly in a vertical plane in response to a lifting force applied to end 77 of lever 64. The distance that weight 110 travels, and also the force needed to lift it, is proportional to the position of carriage 76 on lever 64. Carriage 76 thus functions as a weight resistance and weight distance selector. While the machine of the invention may employ a wide range of weight resistances, it is preferred to employ a single weight or weight stack. It is preferred to provide at least 20, more preferably 30, and most preferably 40 or more locations along the lever for attachment of such a weight, and, thereby to achieve a corresponding minimum number of increments of effective weights. The greatest weight resistance, and therefore the greatest distance travelled by weight 110, is obtained when carriage 76 is located near end 77, and resistance (and distance travelled) decreases as carriage 76 is moved toward end 72. Since weight 110 travels in a vertical plane, there are no horizontal forces which tend to cause undesirable vibrations in weight machine 10.

Figure 4:
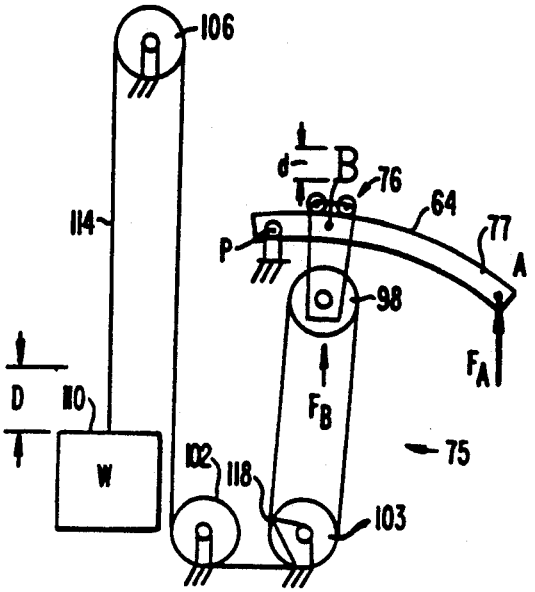
FIG. 4 is a mechanical schematic showing operation of the illustrated embodiment of a weight lifting machine according to the present invention.

FIG. 4 schematically shows the operation of weight lifting machine 10. Force $F_A$ is applied to point A (end 77). From inspection of FIG. 4, it is apparent that $F_A=F_B*(PB/PA)$ where $F_B$ is the force exerted on carriage 76, PB is the straight line distance from pivot axis P to point B, and PA is the straight line distance from pivot axis P to point A. With the pulley arrangement shown, which is preferred, $F_B$ equals twice the force exerted by weight 110, and the distance travelled by weight 110 is equal to twice the distance d travelled by point B. If desired, a single large weight may be used for all resistance levels, and in any event the limited distance which the weight travels for a given range of motion of push bar 26 minimizes bouncing and other inertial effects. Typical values for weight 110, are, for example only, 100–500 lbs. The larger the weight, the less distance it must travel to provide a selected amount of resistance. Other pulley arrangements may be employed to adjust the range of mechanical advantages between the user and the weight.

Figure 5:
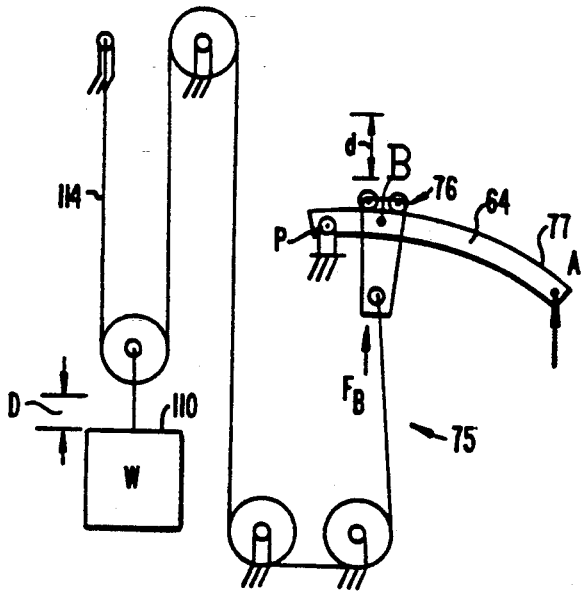
FIGS. 5 and 6 are mechanical schematics showing operation of alternative embodiments of weight lifting machines according to the present invention.
Figure 6:
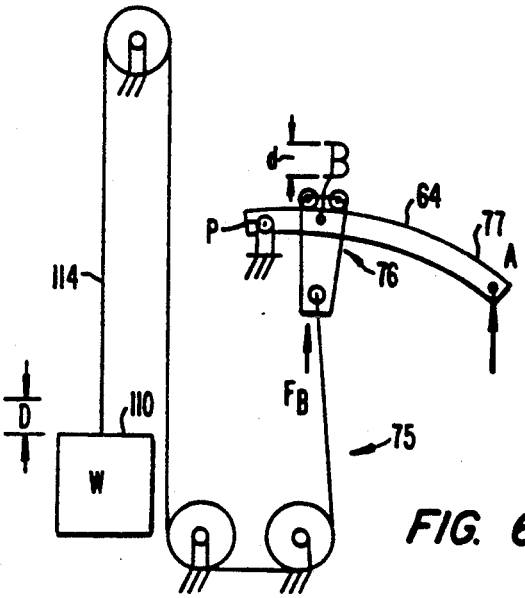
Figure 8:
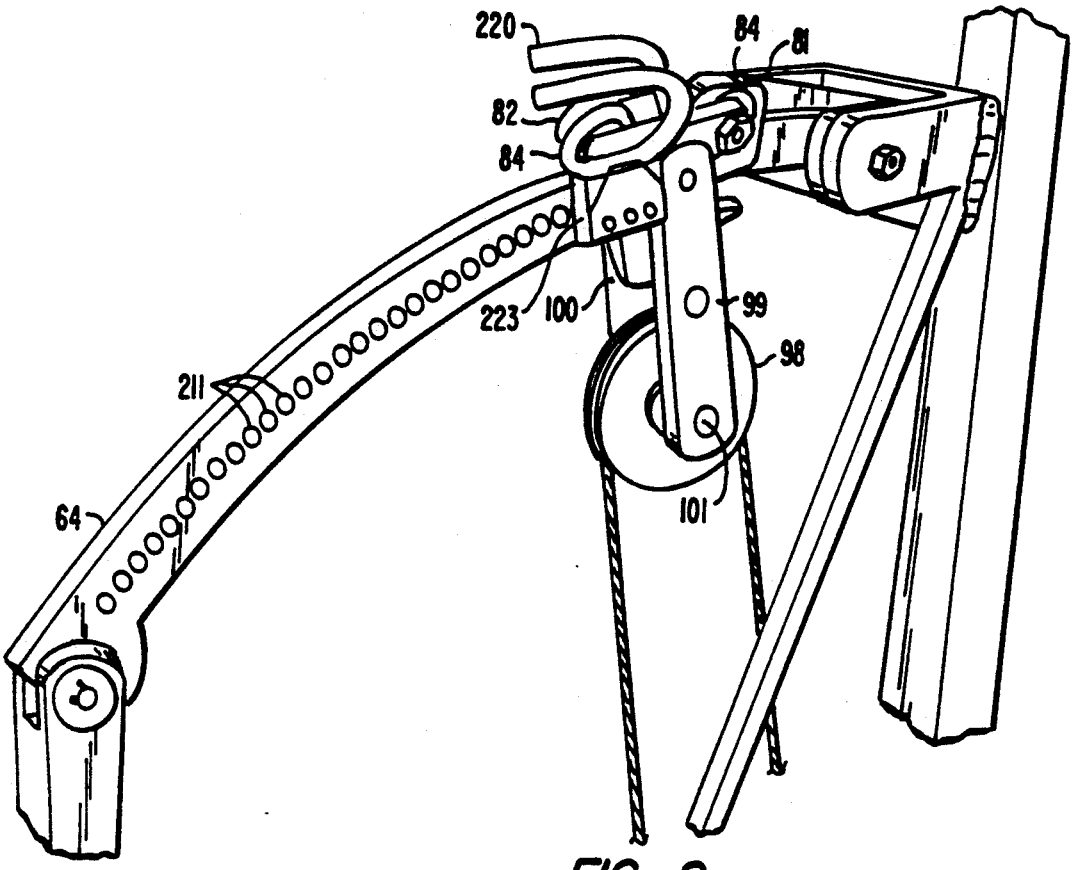
FIG. 8 is a more detailed view of the weight resistance selecting mechanism shown in FIGS. 1-3 comprising an arcuate lever and a carriage which functions as a weight resistance selector.

FIGS. 5–6 show alternative embodiments of pulley arrangement 75. In FIG. 5, $F_8=\frac{1}{2}$ W and D=d/2. In FIG. 6, $F_B$=W and D=d.

Figure 7:
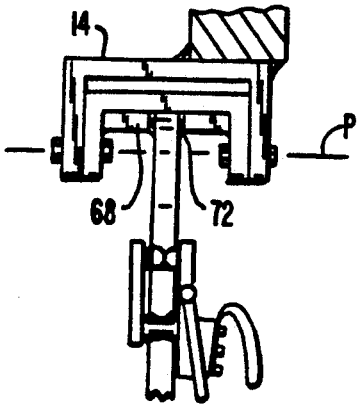
FIG. 7 is a top view of a portion of the weight lifting machine showing how the lever of FIGS. 1-3 is coupled to the frame.

As shown in FIG. 7, end 72 of bar 64 extends beyond pivot axis P. If carriage 76 is placed at pivot axis P, then weight 110 remains stationary in response to movement of lever arm 76, since no lifting action occurs there. If carriage 76 is placed beyond pivot axis P and adjacent to flange 68, then weight 110 assists the movement of lever arm 26. This counterbalancing effect is particularly advantageous for users who are not able to lift lever arm 76 against its own weight.

THE CARRIAGE

Figure 9:
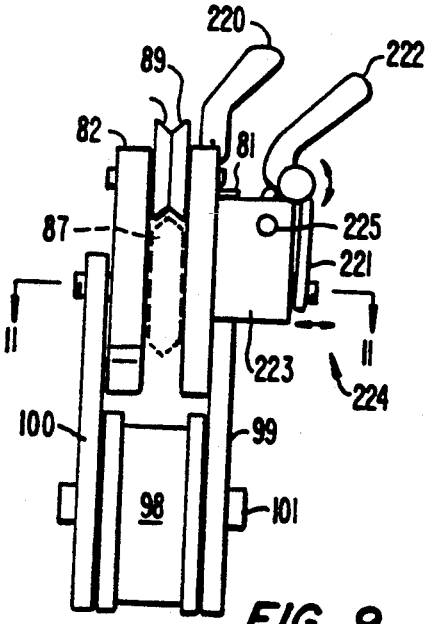
FIG. 9 is a rear view of the carriage shown in FIG. 8.

FIGS. 8–11 show the structure of carriage 76 in more detail. Carriage 76 includes a first frame plate 81 and a second frame plate 82. Rollers 84 are rotatably mounted between first and second frame plates 81 and 82 for allowing carriage 76 to move along lever 64. Second frame plate 82 includes pointer 78 which is used in conjunction with the weight indicating markings on lever 64 (FIG. 1) to select the desired weight or resistance value at which the user desires to train. As shown in FIG. 9, lever 64 has a convex upper surface 87 which mates with a concave peripheral surface 89 of each roller 84 for added stability. Pulley support bar 99 is pivotally coupled to first frame plate 81, and pulley support bar 100 is pivotally coupled to second frame plate 82. Pulley 98 is rotatably supported by pulley support bars 99, 100 through an axle 101. A handle 220 is rigidly coupled to first frame plate 81, and a handle 222 is pivotally coupled to a lever engaging mechanism 224 by extending a bolt 225 through a cylindrical spacer 227 (FIG. 10) attached to handle 222.

Figure 11:
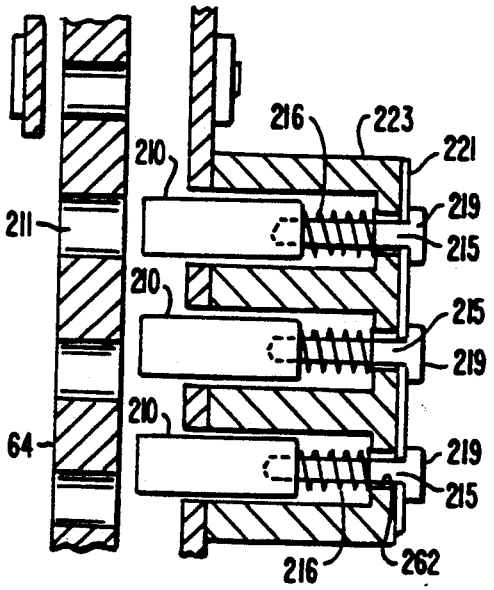
FIG. 11 is a cross sectional view of the carriage taken along line 11—11 of FIG. 9.
Figure 10:
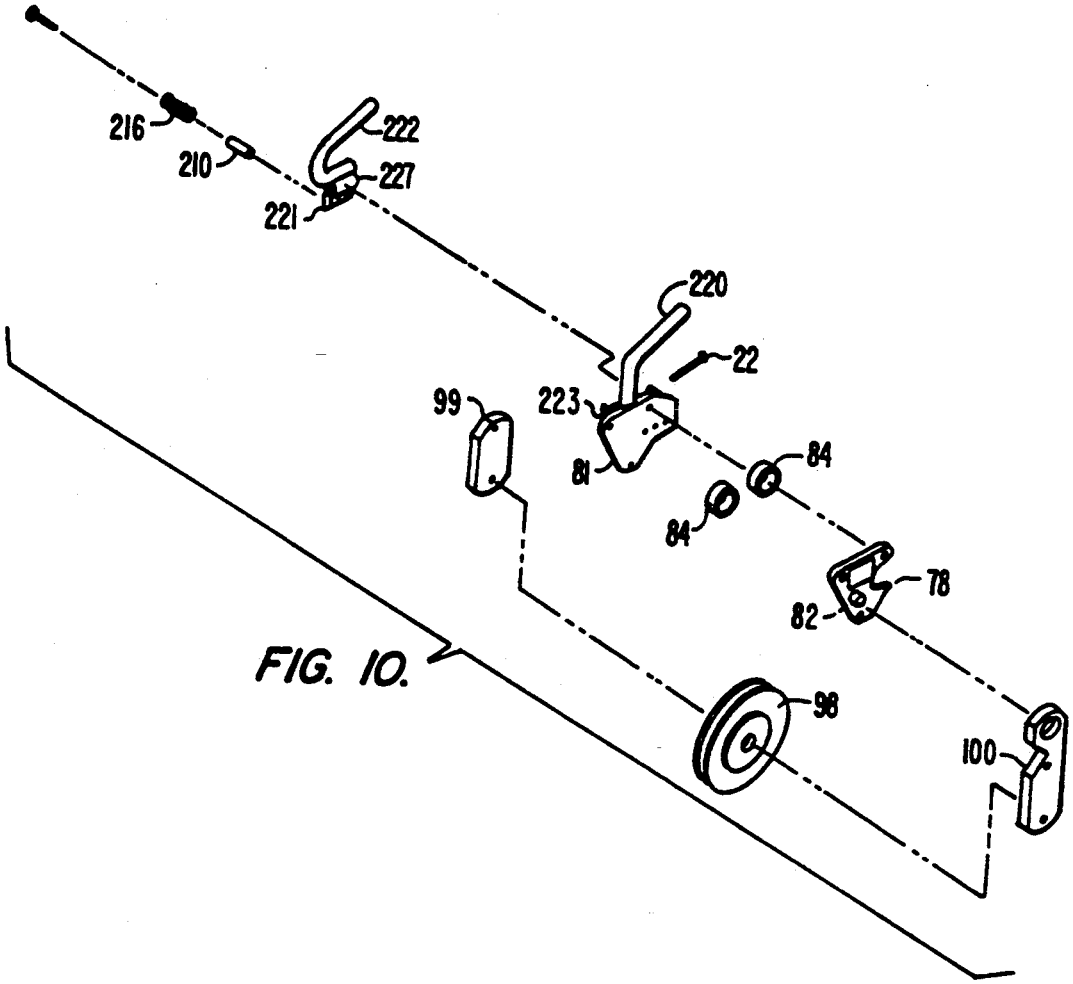
FIG. 10 is an exploded view of the carriage shown in FIG. 8.

As shown in FIGS. 9 and 11, lever engaging mechanism 224 includes a pin support block 223 having a plurality, e.g., three bores 252 for housing three lever engaging pins 210. Lever engaging pins 210 engage apertures 211 in lever 64 for fixing carriage 76 at a selected location along lever 64. In this embodiment, lever 64 contains 34 apertures located on nominal 0.469-inch centers. Pins 210 are centered at $1\frac{1}{3}$ times the distance between adjacent apertures (i.e., on nominal 0.625-inch centers). Thus, as shown in FIG. 11, only one pin 210 can engage an aperture 211 in lever 64 at a time. This allows carriage 76 to be placed at approximately 100 detented positions along lever 64, thus providing substantially more resistance increments than is available in conventional weight stack machines. The number of pins 210 may be increased to correspondingly multiply the number of detented positons available.

Each lever engaging pin 210 is coupled to a respective handle engaging bolt 215 which extends through smaller counterbores 262 in pin support block 223. A spring 216 is disposed on each handle engaging bolt 215 for biasing its corresponding lever engaging pin 210 toward lever 64. A retraction plate 221 is affixed to handle 222 and is disposed between pin support block 223 and heads 219 of the plurality of handle engaging bolts 215. When handles 220 and 222 are squeezed together, retraction plate 221 forces handle engaging bolts 215 toward the right in FIG. 9 which, in turn, causes lever engaging pins 210 to retract into pin support block 223.

Figure 12:
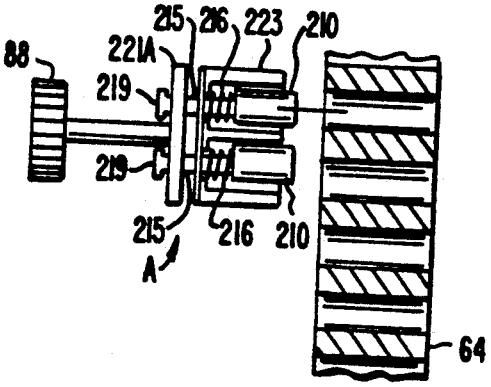
FIG. 12 is a view of an alternative embodiment of a carriage according to the present invention.

FIG. 12 shows an alternative embodiment of a lever engaging mechanism 224A. The components which are the same as those shown in FIGS. 9 and 11 are numbered the same. In this embodiment, a handle (e.g., a knob) 88 is attached to a retraction plate 221A. Pins 210 are thus retracted by pulling on knob 88. Two pins 210 are used in this embodiment, and they are also offset relative to apertures 211 in lever 64. Thus, when one spring loaded pin 210 is disposed within one of apertures 211, then the other spring loaded pin 210 abuts against lever 64 in a retracted position. This embodiment allows carriage 76 to be placed at approximately 68 detented positions along lever 64, and this too provides substantially more resistance increments then is available in conventional weight stack machines. Of course, three or more lever engaging pins could be used as with the embodiment shown in FIGS. 9 and 11.

Figure 13:
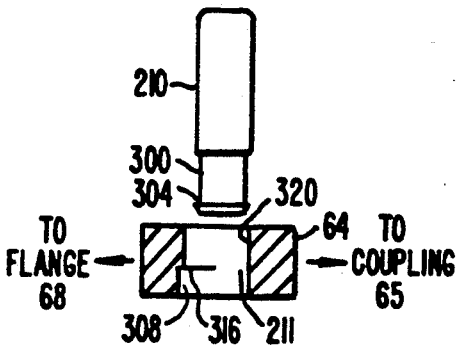
FIG. 13 is a cross sectional view of an alternative embodiment of a pin used in the carriage together with an apertured section of the arcuate lever.

FIG. 13 is a cross sectional view of an alternative embodiment of a pin 210 used in carriage 76 together with an apertured section of lever 64. In this embodiment, a portion 300 of pin 210 is milled to a lesser diameter than the rest of pin 210 for forming an abutment 304. Similarly, a portion of lever 64 is counterbored at a side 308 of aperture 211 for forming an abutment 316. It should be noted that, in this embodiment, the counterbore does not extend along the entire circumference of aperture 211, and a side 320 of aperture 211 remains smooth.

Figure 14:
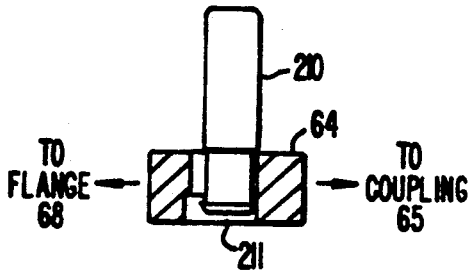
FIGS. 14 and 15 are cross sectional views of the pin/lever assembly of FIG. 13 showing the pin disposed at different positions within the illustrated aperture.
Figure 15:
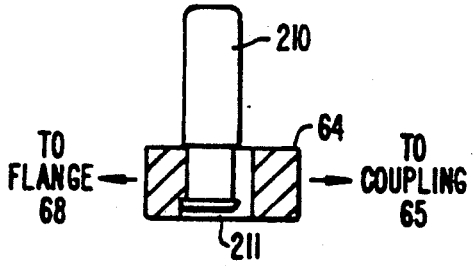

FIGS. 14 and 15 show pin 210 disposed within aperture 211 under different conditions. FIG. 14 shows the position of pin 210 when lever 64 is at rest (e.g., as shown in FIGS. 1–2), whereas FIG. 15 shows the position of pin 210 when lever 64 pivots upwardly as shown in FIG. 3. When lever 64 is in the position shown in FIGS. 1 or 2, there is no net force acting toward either end of lever 64 (carriage 76 is unloaded). Thus, the carriage 76 may be moved easily along lever 64, and pin 210 slides easily in and out of aperture 211, especially since side 320 of aperture 211 is smooth. When the pin is disengaged with lever 64 at rest, carriage 76 tends to remain stationary with little or no driving force toward either end of lever 64. On the other hand, when lever 64 is oriented as shown in FIG. 3, there is a net force tending to pull carriage 76 toward end 72 (i.e., carriage 76 is under a load). Of course, when pin 210 is disposed within aperture 211, then carriage 76 is held stationary despite the created force. However, if pin 210 is pulled out of aperture 211 when carriage 76 is in this position, the carriage moves rapidly toward end 72, thus disrupting the exercise session. Abutment 304 of pin 210 and abutment 316 within aperture 211 cooperate to prevent this from occurring. That is, when lever 64 is in the position shown in FIG. 3, pin 210 is biased toward side 308 of aperture 211. Abutment 304 therefore engages with abutment 316, essentially locking the assembly together and preventing the inadvertent or malicious removal of pin 210 from aperture 211. Of course, when lever 64 is again lowered, carriage 76 may be easily moved so that abutment 304 disengages from abutment 316, and pin 210 once again may be easily removed.

Figure 16:
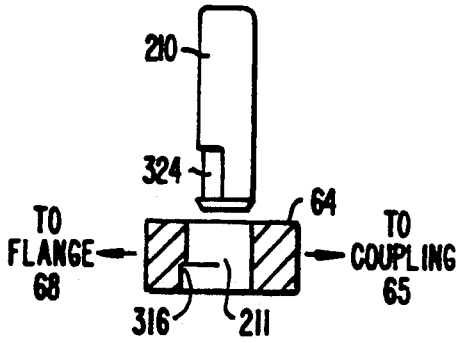
FIGS. 16 and 17 are cross sectional views of alternative embodiments of the pin/lever assembly of FIG. 13.
Figure 17:
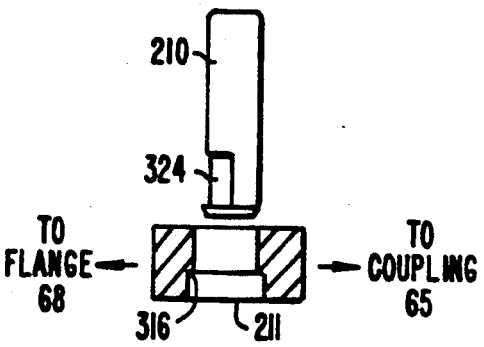

FIGS. 16 and 17 illustrate alternative embodiments of the pin/bar assembly shown in FIG. 13. In these embodiments, pin 210 is milled so that only a portion 324 of pin 210 facing abutment 316 is milled to a smaller diameter. In FIG. 17, aperture 312 is fully counterbored so that abutment 316 extends along the entire circumference of aperture 312. Both embodiments operate the same way as the embodiment shown in FIGS. 13–15. In any event, the locking mechanisms provide a simple and inexpensive way to provide secure engagement of carriage 76 with lever 64 when carriage 76 is under load.

Although a pin arrangement has been shown for coupling carriage 76 to lever 64, it should be noted that carriage 76 may be coupled to lever 64 using clamps, gears, and many other coupling mechanisms.

The principles of the present invention may be applied to construct many types of resistance exercise machines merely by attaching various user interfaces to end 77 of lever 64. Such devices include machines designed for leg extension (or curl), leg press, calf raise, hip rotations, chest press, shoulder press, inclined press, tricep press, arm curl, tricep extension, lateral (deltoid) pulldown, rowing, lateral raise, butterfly (pectoral) exercises, pullover exercises, dead lift exercises and Smith-type machines.

LEG EXTENSION MACHINE

FIGS. 18A–G are views of a particular embodiment of a leg extension machine 150 according to the present invention which incorporates weight lifting machine 10 shown in FIG. 1. Leg extension machine 150 includes an expanded version of frame 14 upon which is disposed a seat pad 18 and a backrest 22. Both seat pad 18 and backrest 22 may be constructed to be adjustable to any desired position. Disposed in front of seat pad 18, and pivotally coupled to frame 14 by a coupling 24, is a push bar 26 having pads 30 (FIG. 18B) for contacting a user's legs. Push bar 26 is coupled to a shaft 34 which, in this embodiment, telescopingly mates with another shaft 38. Shaft 38 has apertures 42 (FIG. 18A) for receiving a pin 46 so that push bar 26 may be set in a desired initial position. This, in turn, sets the range of motion of push bar 26 to meet the user's individual needs. The shafts and their connection can be referred to collectively as an adjustable (in length) shaft.

Shaft 38 is pivotally coupled by a coupling 48 to a rigid member such as a truss 50 which, in turn, is pivotally coupled to frame 14 by couplings 54 and 56. Truss 50 is also pivotally coupled by a coupling 52 to a rigid drive link 60 at one end thereof. The other end of drive link 60 is coupled to end 77 of lever 64 by a coupling 65. The rigidity of the linkage mechanisms that convert motion of the user's legs into an upward compressive motion at end 77 of lever 64 ensures that most of the force exerted by the user is actually used to lift weight 110. Since weight 110 is suspended freely, belt 114 is always tensioned and the user experiences full resistance even at the start and stop positions. Truss 50 allows the lever, carriage, pulleys, and weight to be located off to the side of the user since it translates the user's motion from the plane which contains shaft 38 to the offset plane which contains drive link 60. Since truss 50 is located below and directly beneath seat pad 18, a significant spacing saving results. Furthermore, lever 64, drive link 60, truss 50 and their respective connections to frame 14 create a four-bar linkage mechanism which constrains the path the links move relative to each other. This allows the machine designer to tailor the amount of movement of lever 64 relative to the position of push bar 26 to produce a cam effect.

In operation, the user selects the desired start position of push bar 26 using pin 46 and then sits on seat pad 18. See FIG. 18F. The user's legs are positioned against pads 30, and carriage 76 is placed in a desired position along lever 64. This is accomplished by squeezing handles 220, 222 (or pulling on knob 88) and moving carriage 76 along lever 64 until the desired position is reached, and then releasing handles 220 and 222 (or knob 88) so that one of the spring loaded pins 210 projects into one of apertures 211, and pointer 78 on carriage 76 is aligned with a desired weight value. Since lever 64 is horizontally disposed near the user, any weight value may be selected from a sitting position. Thereafter, the user lifts up on push bar 26.

Figure 18A:
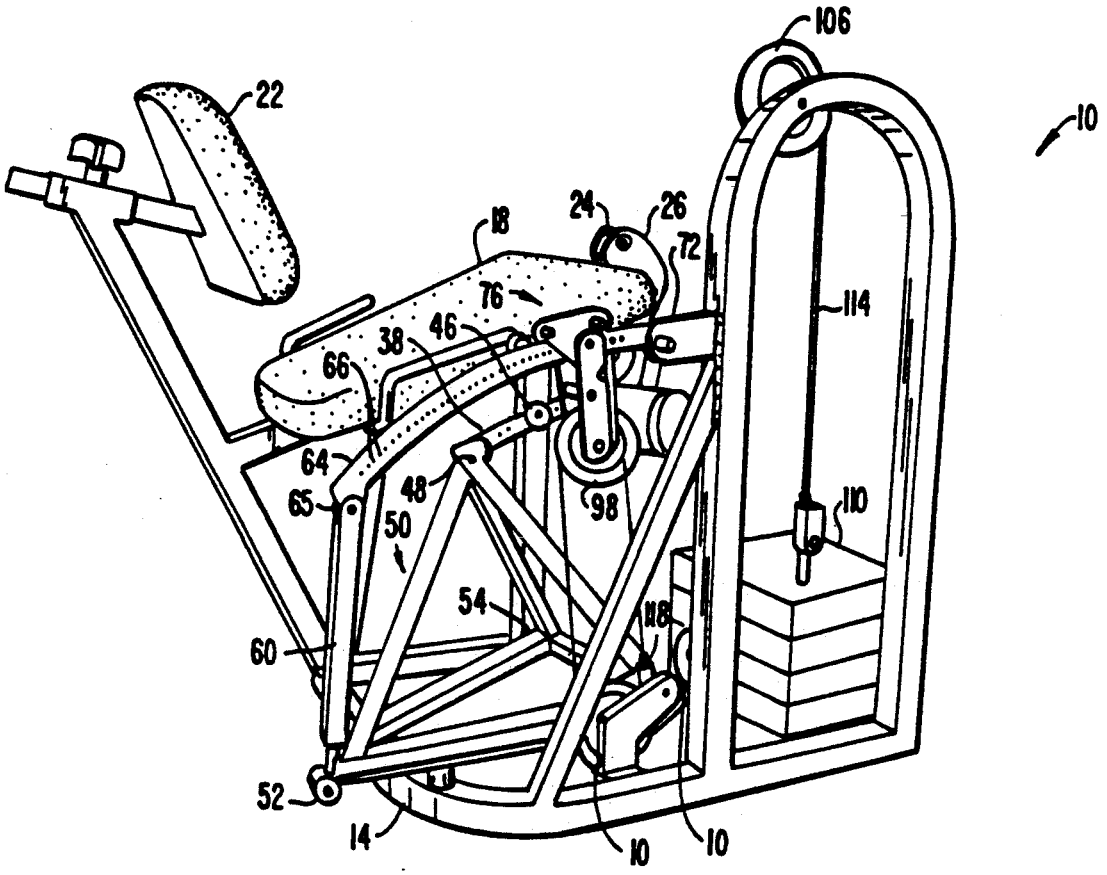
FIG. 18A is a left side view of a particular embodiment of a leg extension machine according to the present invention which incorporates the weight lifting machine shown in FIG. 1.
Figure 18B:
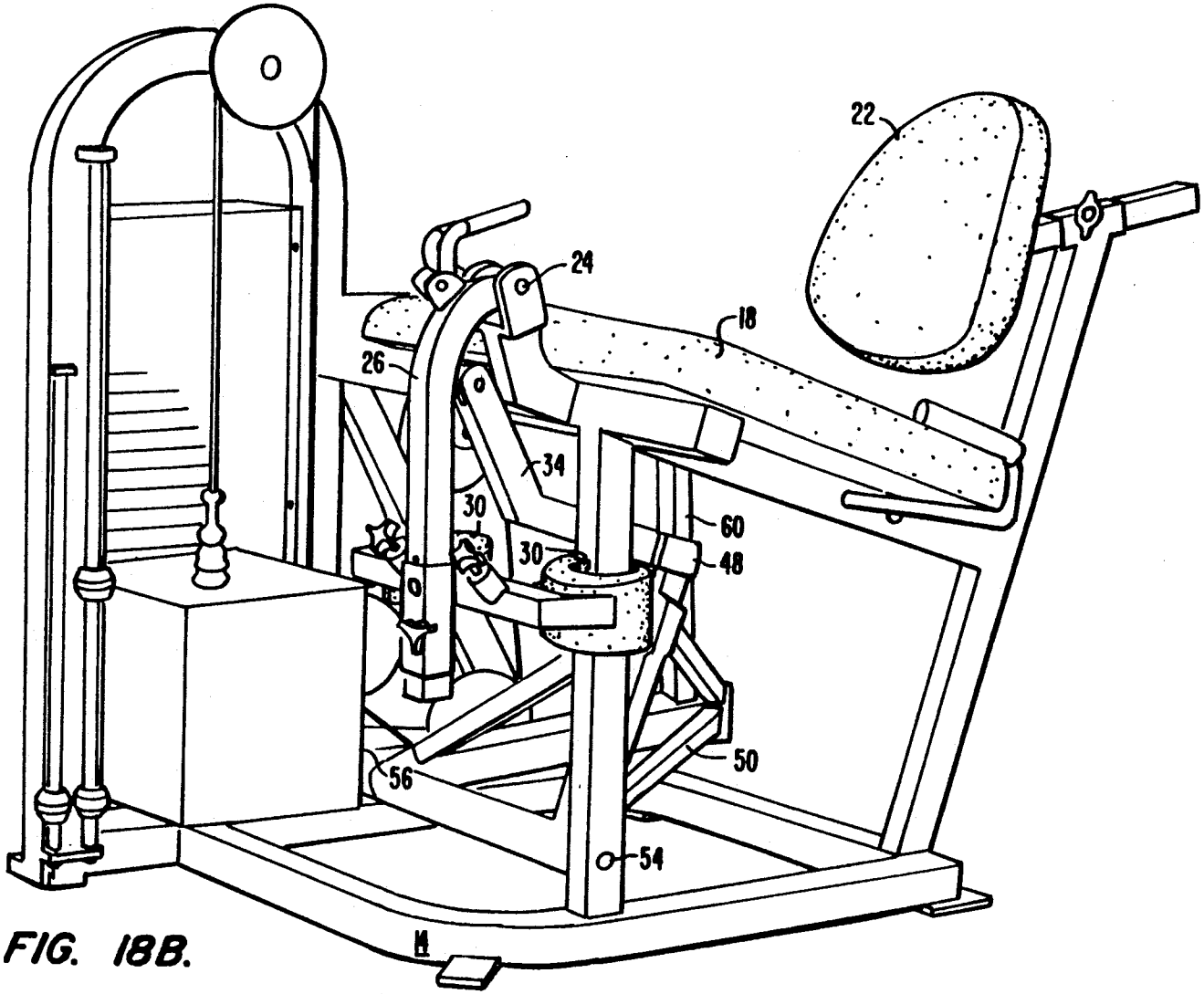
FIG. 18B is a right side view of the leg extension machine shown in FIG. 18A.
Figure 18C:
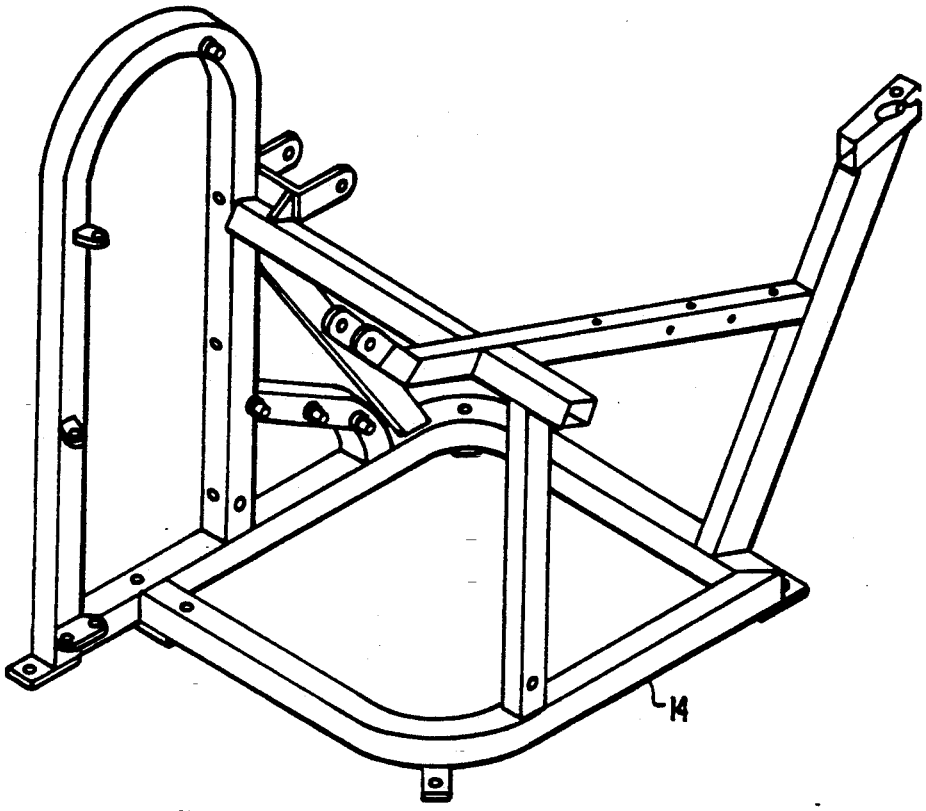
FIG. 18C is a perspective view of the frame for the leg extension machine shown in FIG. 18A.
Figure 18D:
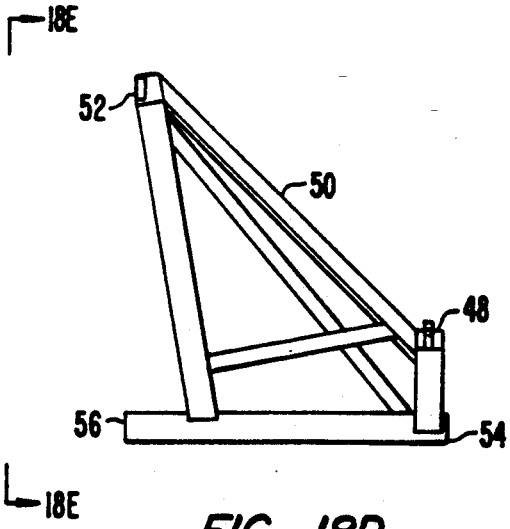
FIG. 18D is a top view of the pivoting truss used in the leg machine of FIG. 18A.
Figure 18E:
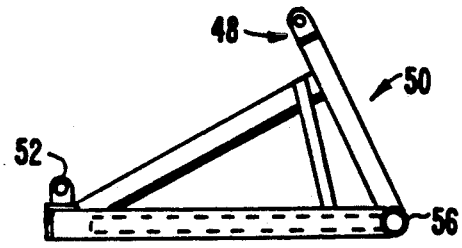
FIG. 18E is a view of the pivoting truss taken along line 18E-18E of FIG. 18D.
Figure 18F:
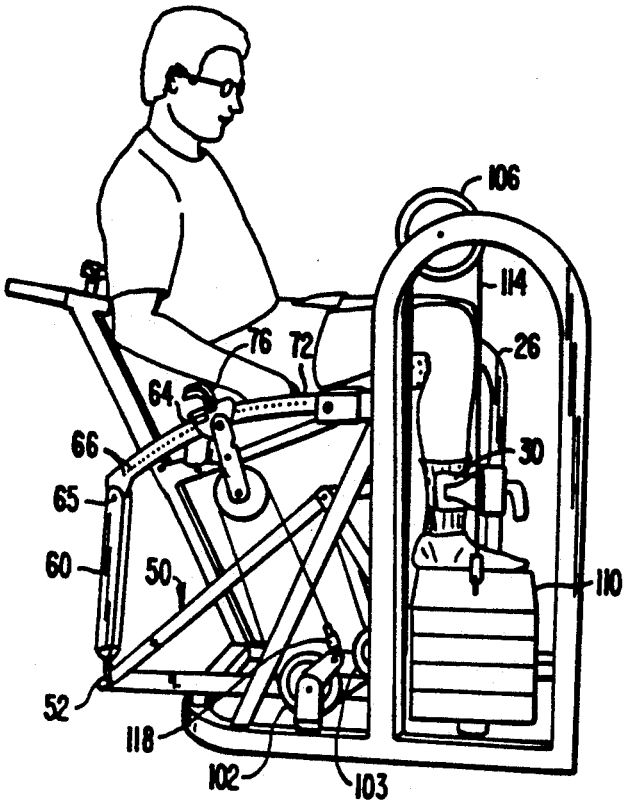
FIG. 18F is a left side view of the leg extension machine of FIG. 18A in an initial position.
Figure 18G:
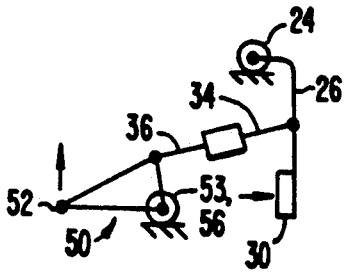
FIG. 18G is a schematic drawing of the leg extension machine in the position shown in FIG. 18F.
Figure 18H:
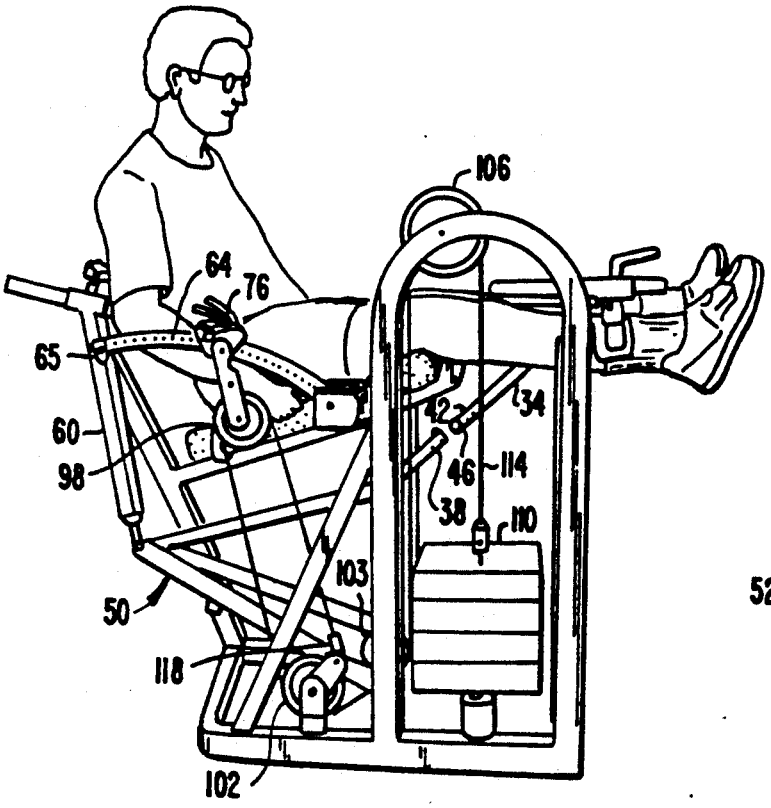
FIG. 18H is a is a left side view of the leg extension machine of FIG. 18A in an extended position.
Figure 18I:
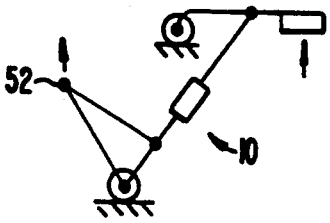
FIG. 18I is a schematic drawing of the leg extension machine in the position shown in FIG. 18H.

FIGS. 18G and 18I are schematic diagrams of leg extension machine 150 in the position shown in FIGS. 18F and 18H, respectively. Corresponding reference numerals are used for the elements. The arrows represent the forces applied to pads 30 and to drive link 60 (not shown). The telescoping pinned connection between shafts 34 and 38 that allows a selection of the desired initial position of push bar 26, and thus its range of motion, is denoted as a box joining the shafts. As can be seen from FIGS. 18F–I, the force against leg pads 30 causes rotation of truss 50 about the axis of couplings 54, 56 and a resulting upward force on drive link 60.

The above is a description of a complete machine which incorporates weight machine 10 of FIG. 1. It should be appreciated that leg extension machine 150 is a modular structure which generally comprises a user interface (e.g., pads 30), a linkage mechanism (e.g., push bar 26, shafts 34 and 38, and truss 50), which translates the user's motion to upward motion located off to the side of the user, and a stand-alone, modular weight lifting mechanism (weight machine 10). A description of alternative embodiments of weight training machines follows. They share the same concept of having a user's motion coupled to a pivoting truss (e.g. truss 50) which translates the user's motion from a first plane of motion to a second plane of motion typically located off to the side of the user wherein the motion is used to lift a resistance element such as a weight (e.g., by pushing drive link 60 and lever 64 upwardly). The different machines are constructed by changing the form and location of push bar 26, or by substituting push bar 26 and/or truss 50 with other linkage mechanisms. Only the structures which differ from leg extension machine 150 (except seating arrangements) will be described in detail.

LEG PRESS MACHINE

Figure 19A:
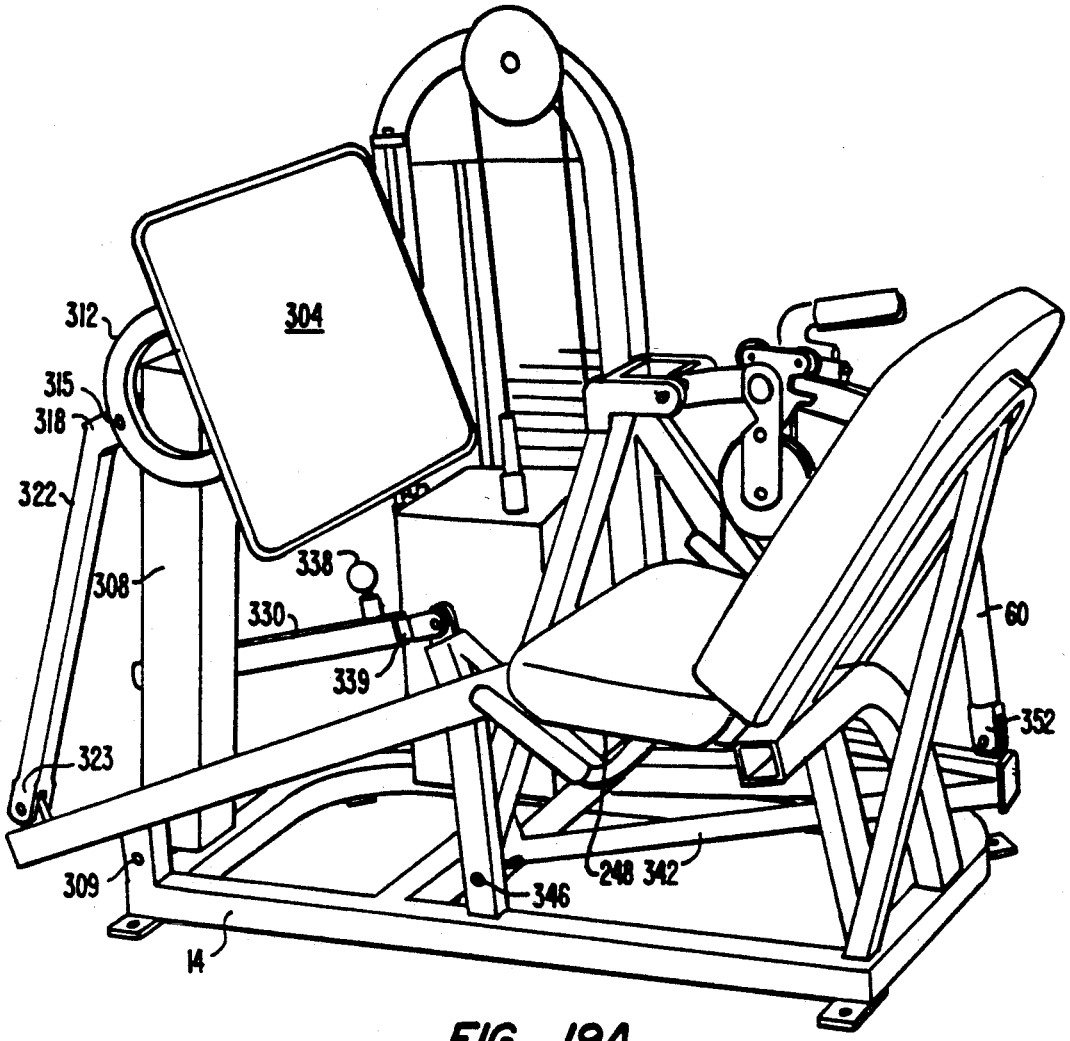
FIG. 19A is a right side view of a particular embodiment of a leg press machine according to the present invention which incorporates the weight lifting machine of FIG. 1.
Figure 19D:
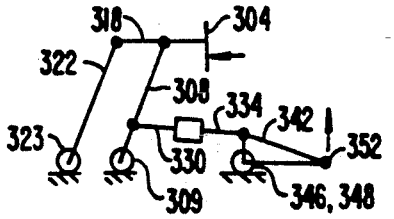
FIGS. 19D-E are schematic drawings of the leg press machine in initial and extended positions.
Figure 19E:
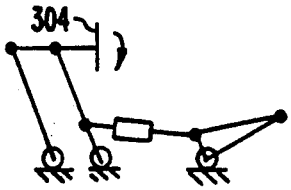
Figure 19B:
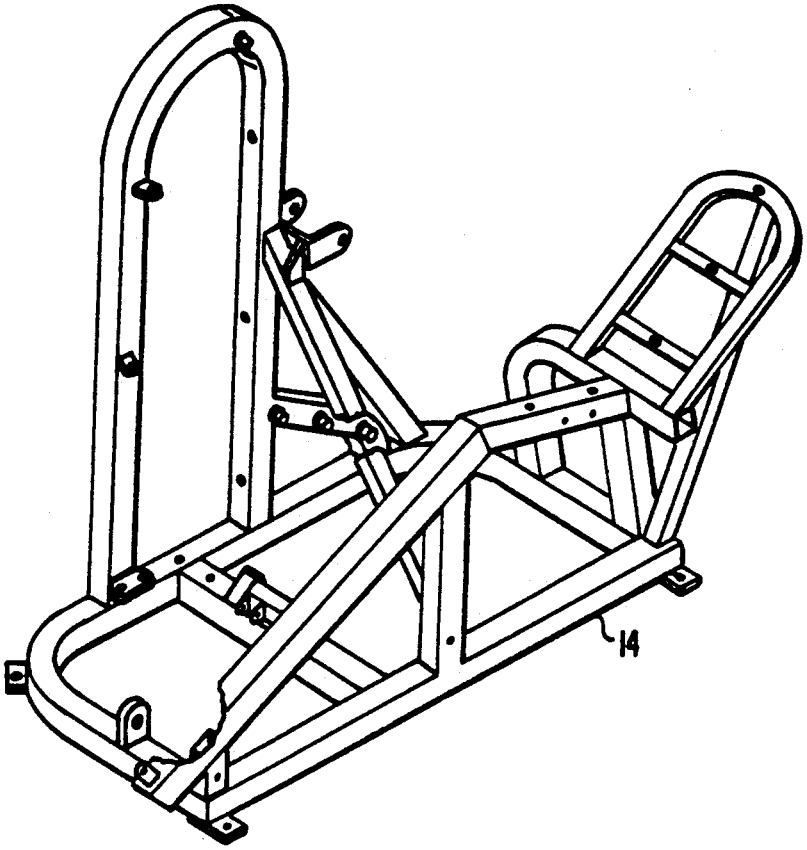
FIG. 19B is a perspective view of the frame for the leg press machine shown in FIG. 19A.
Figure 19C:
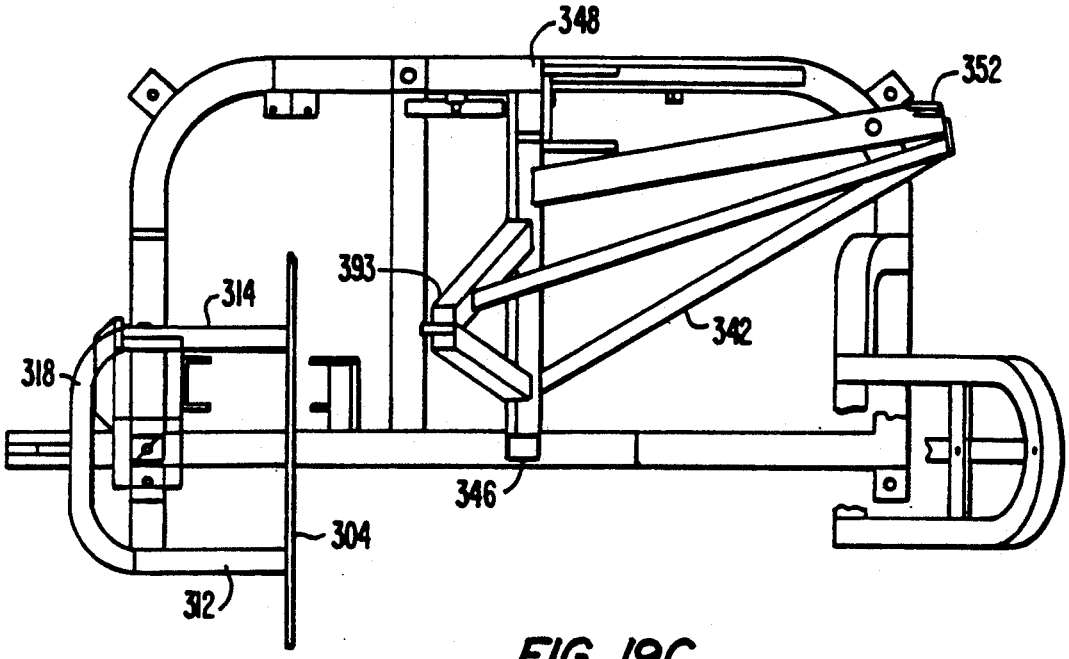
FIG. 19C is a top view of the frame of FIG. 19B showing the connection of the pivoting truss.

FIGS. 19A–C are views of a particular embodiment of a leg press machine 300 according to the present invention which incorporates weight lifting machine 10 shown in FIG. 1. Leg press machine 300 includes a foot plate 304 which is pivotally coupled to a push bar 308 through semi-circular braces 312, 314 and a coupling 315. A transverse bar 318 is rigidly connected to braces 312 and 314 and pivotally coupled to a pivot control bar 322. Pivot control bar 322 is pivotally coupled to frame 14 by a coupling 323. Push bar 308 is pivotally coupled to a shaft 330 which telescoping mates with another shaft 334. Shaft 330 includes a pin 338 which engages apertures (not shown) in shaft 334 for selecting the desired initial position of foot plate 304 (and hence its range of motion). Shaft 334 is pivotally coupled to a truss 342 by a coupling 343. Truss 342 is pivotally coupled to frame 14 by couplings 346 and 348 and to drive link 60 by a coupling 352. Push bar 308 is pivotally coupled to frame 14 by a coupling 309.

FIG. 19D is a schematic diagram showing leg press 300 in an initial position, and FIG. 19E is a schematic diagram showing leg press 300 in an extended position. Pivot control bar 322 ensures that foot plate 304 pivots in a controlled manner as the user pushes the foot plate from the position shown in FIG. 19D to the position shown in FIG. 19E.

ABDOMINAL CRUNCH MACHINE

FIGS. 20A–D are views of a particular embodiment of an abdominal crunch machine 400 according to the present invention which incorporates weight lifting machine 10 shown in FIG. 1. Abdominal crunch machine 400 includes a push bar 404 that is pivotally coupled to frame 14 by a coupling 408. Push bar 404 includes handles 412, 414 and a pad 418. Push bar 404 is pivotally coupled to a shaft 422 by a coupling 426. Shaft 422 telescopingly mates with a shaft 430. Shaft 422 includes a pin 434 which engages apertures (not shown) in shaft 430 for selecting a desired initial position of push bar 404 (and hence its range of motion). Shaft 430 is pivotally coupled to a truss 438 by a coupling 442. Truss 438 is pivotally coupled to frame 14 by couplings 450 and 454 and to drive link 60 through a coupling 460.

Figure 20A:
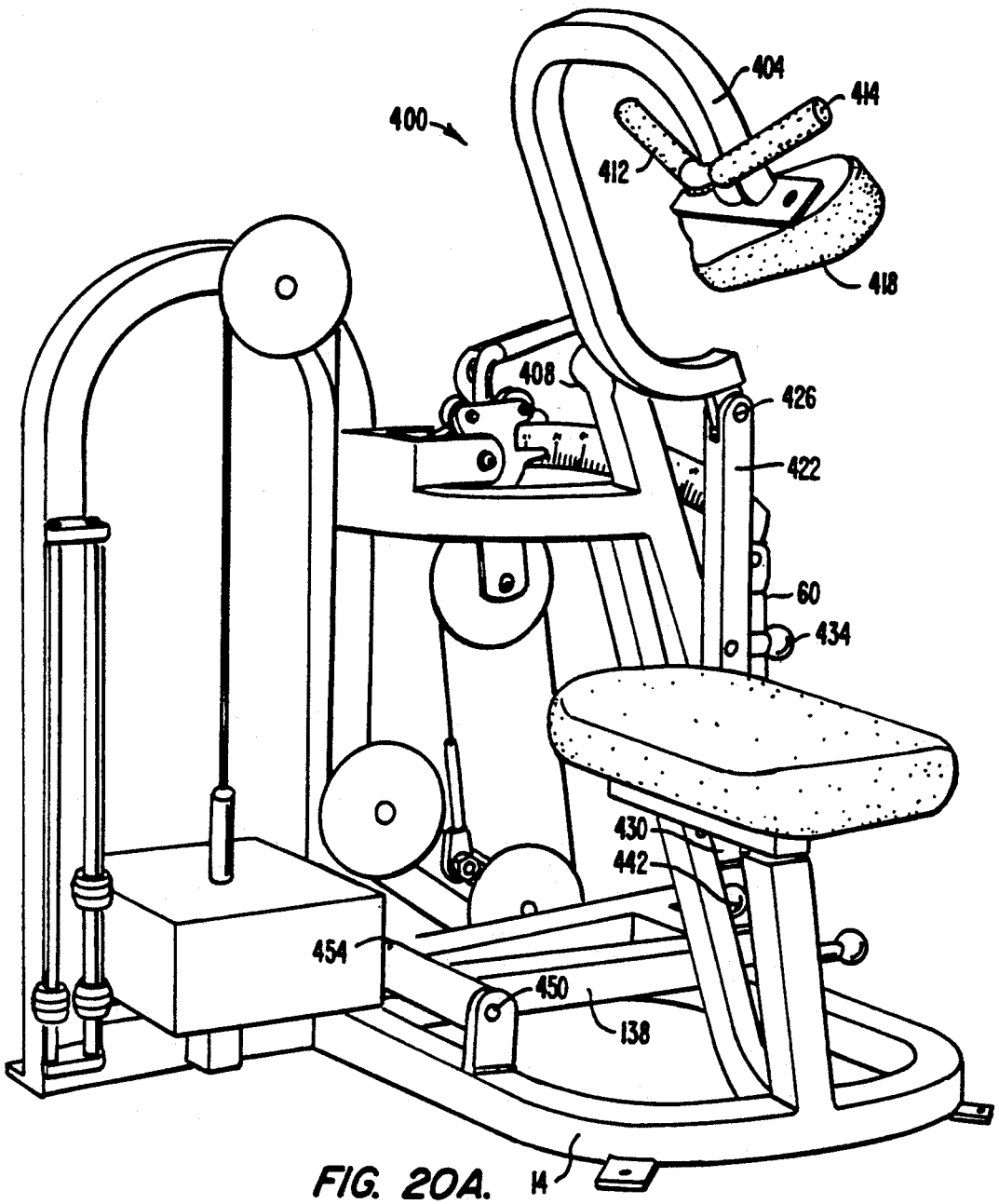
FIG. 20A is a right side view of a particular embodiment of an abdominal crunch machine according to the present invention which incorporates the weight lifting machine shown in FIG. 1.
Figure 20E:
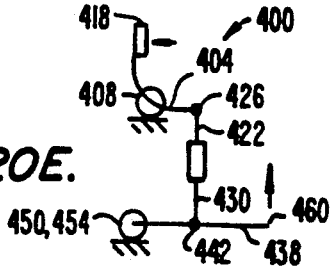
FIGS. 20E-F are schematic drawings of the abdominal crunch machine in initial and forward positions.
Figure 20F:
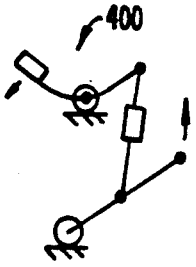
Figure 20B:
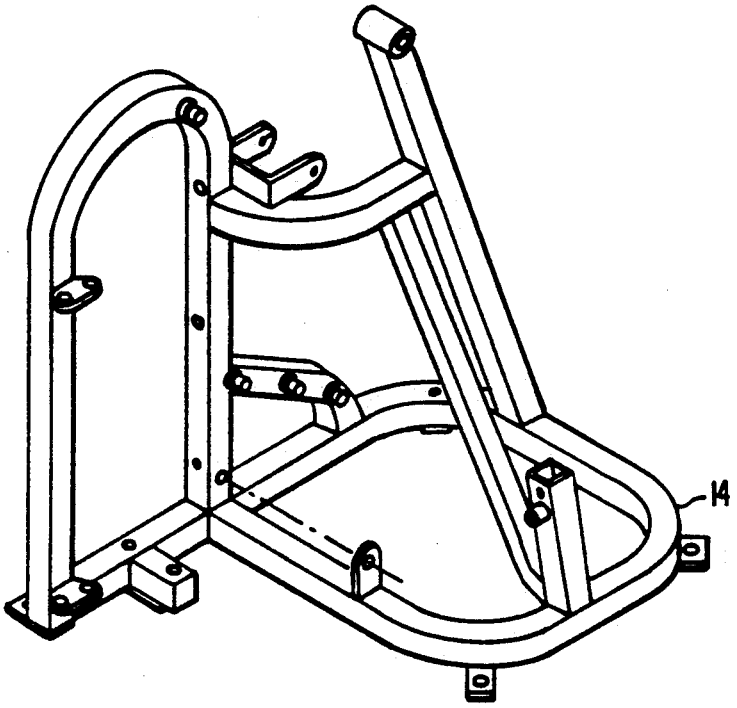
FIG. 20B is a perspective view of the frame for the abdominal crunch machine shown in FIG. 20A.
Figure 20C:
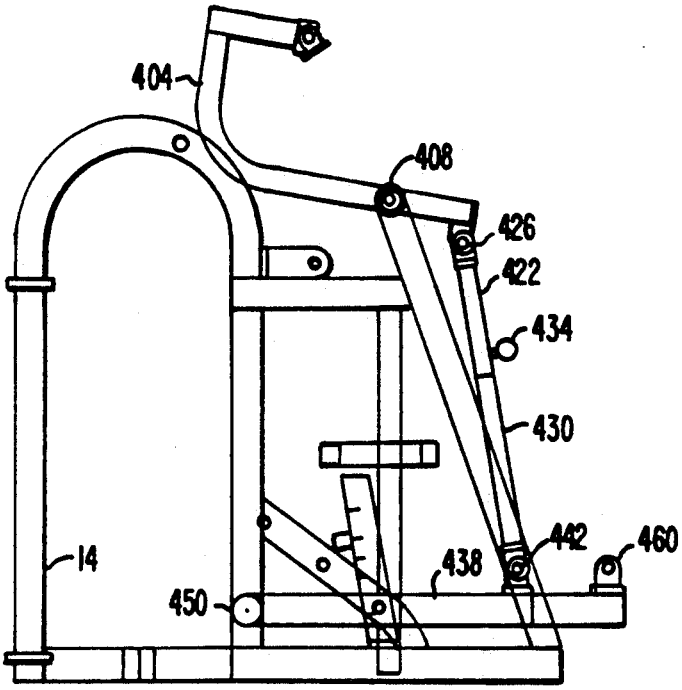
FIG. 20C is a side schematic view of the abdominal crunch machine shown in FIG. 20A.
Figure 20D:
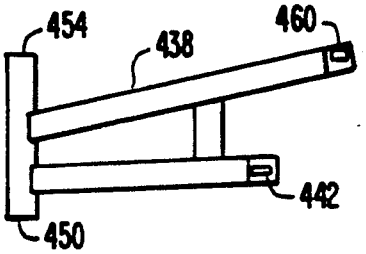
FIG. 20D is a top view of the pivoting truss for the abdominal machine shown in FIG. 20A.

FIGS. 20E–F are schematic drawings of abdominal crunch machine 400 in initial and forward positions, respectively. A user grasps handles 412 and 414 while pressing on pad 418 with his or her chest. This, in turn, causes truss 438 to pivot and create an upward force at drive link 60.

SHOULDER PRESS MACHINE

FIGS. 21A–D are views of a particular embodiment of a shoulder press machine 500 according to the present invention which incorporates weight lifting machine 10 shown in FIG. 1. Shoulder press machine 500 includes press bars 504, 508 coupled to an upper support 512 by couplings 516, 520. Each push bar 504, 508 includes a handle 524 which provides a neutral grip position and a handle 528 which provides a pronated grip position. A counterweight 532 is coupled to push bars 504, 508 to offset the weight of push bars 504 and 508 during range of motion adjustment. A shaft 540 is coupled to push bars 504 and 508 in front of couplings 516 and 520. Shaft 540 telescopingly mates with another shaft 544. A pin 548 associated with shaft 540 engages apertures (not shown) in shaft 544 for setting the desired initial position of push bars 504 and 508 (and hence their range of motion). Shaft 544 is pivotally coupled to a truss 550 by a coupling 554. Truss 550 is pivotally coupled to frame 14 by couplings 558, 560 and to drive link 60 by a coupling 562.

Figure 21E:
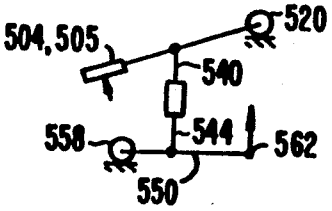
FIGS. 21E-F are schematic drawings of the shoulder press machine in initial and extended positions.
Figure 21F:
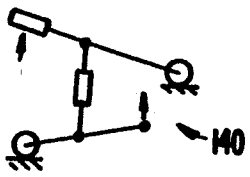
Figure 21A:
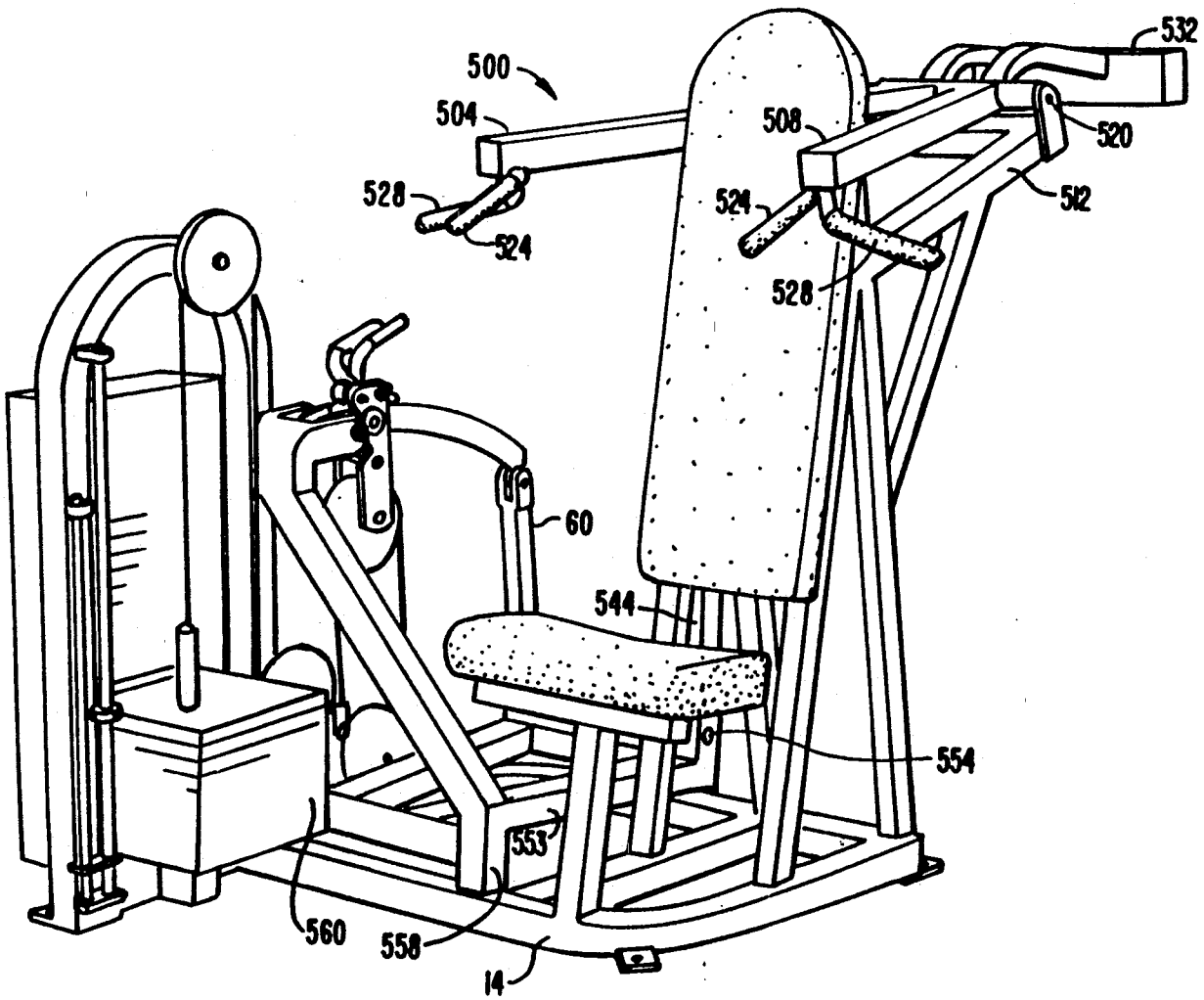
FIG. 21A is a right side view of a particular embodiment of a shoulder press machine according to the present invention which incorporates the weight lifting machine shown in FIG. 1.
Figure 21B:
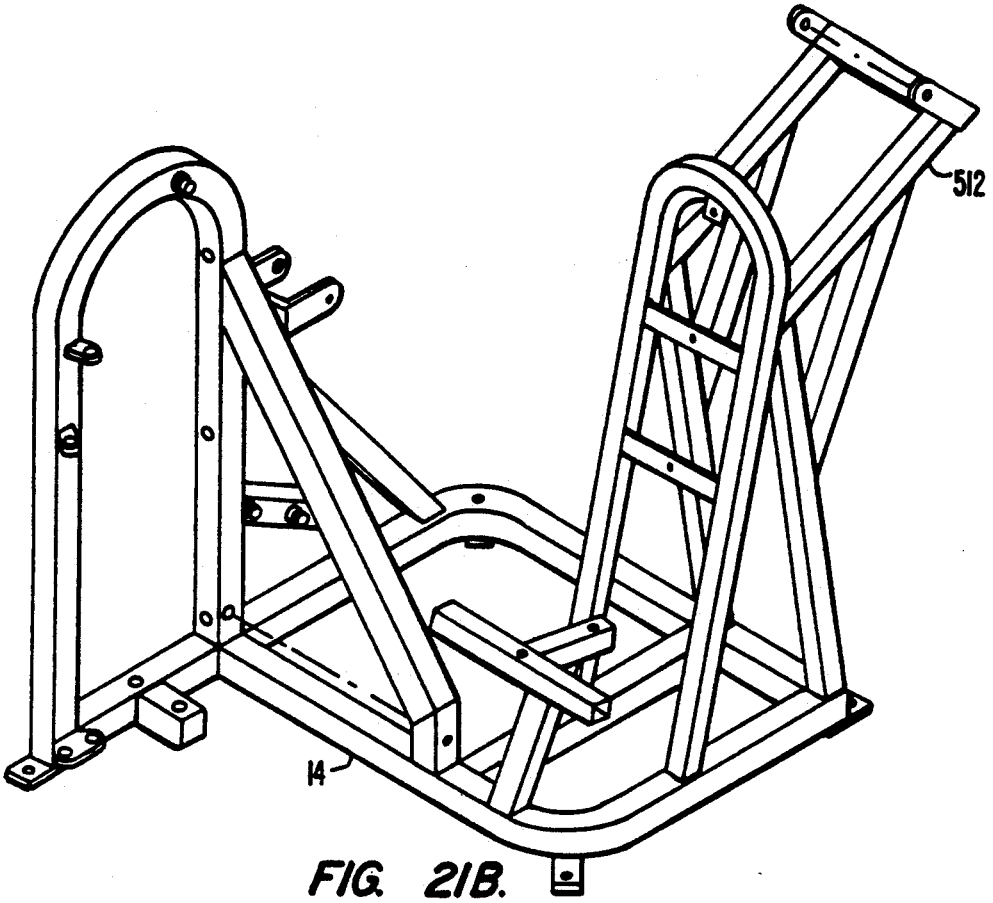
FIG. 21B is a perspective view of the frame for the shoulder press machine shown in FIG. 21A.
Figure 21C:
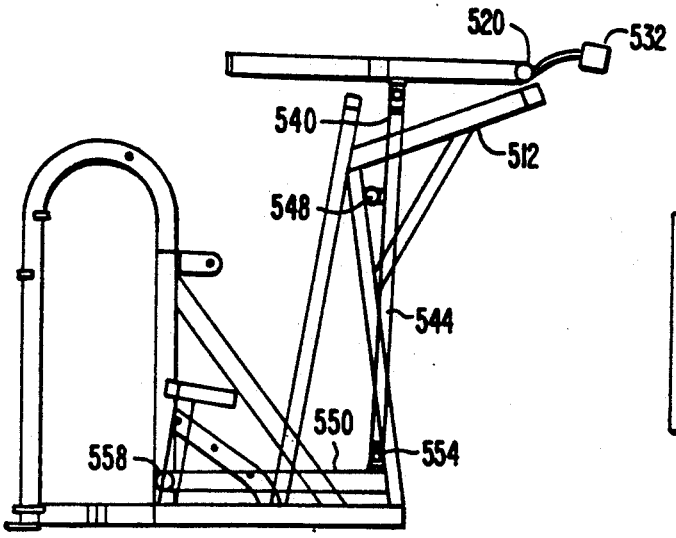
FIG. 21C is a side schematic view of the shoulder press machine shown in FIG. 21A.
Figure 21D:
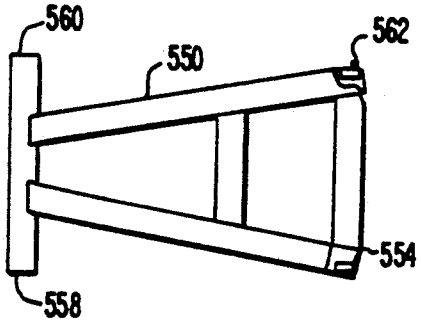
FIG. 21D is a top view of the pivoting truss for the abdominal machine shown in FIG. 21A.

FIGS. 21E–F are schematic diagrams of shoulder press machine 500 in initial and extended positions. Pressing up on push bars 504 and 508 cause truss 550 to pivot and create an upward force at drive link 60.

LAT PULLDOWN MACHINE

Figure 22A:
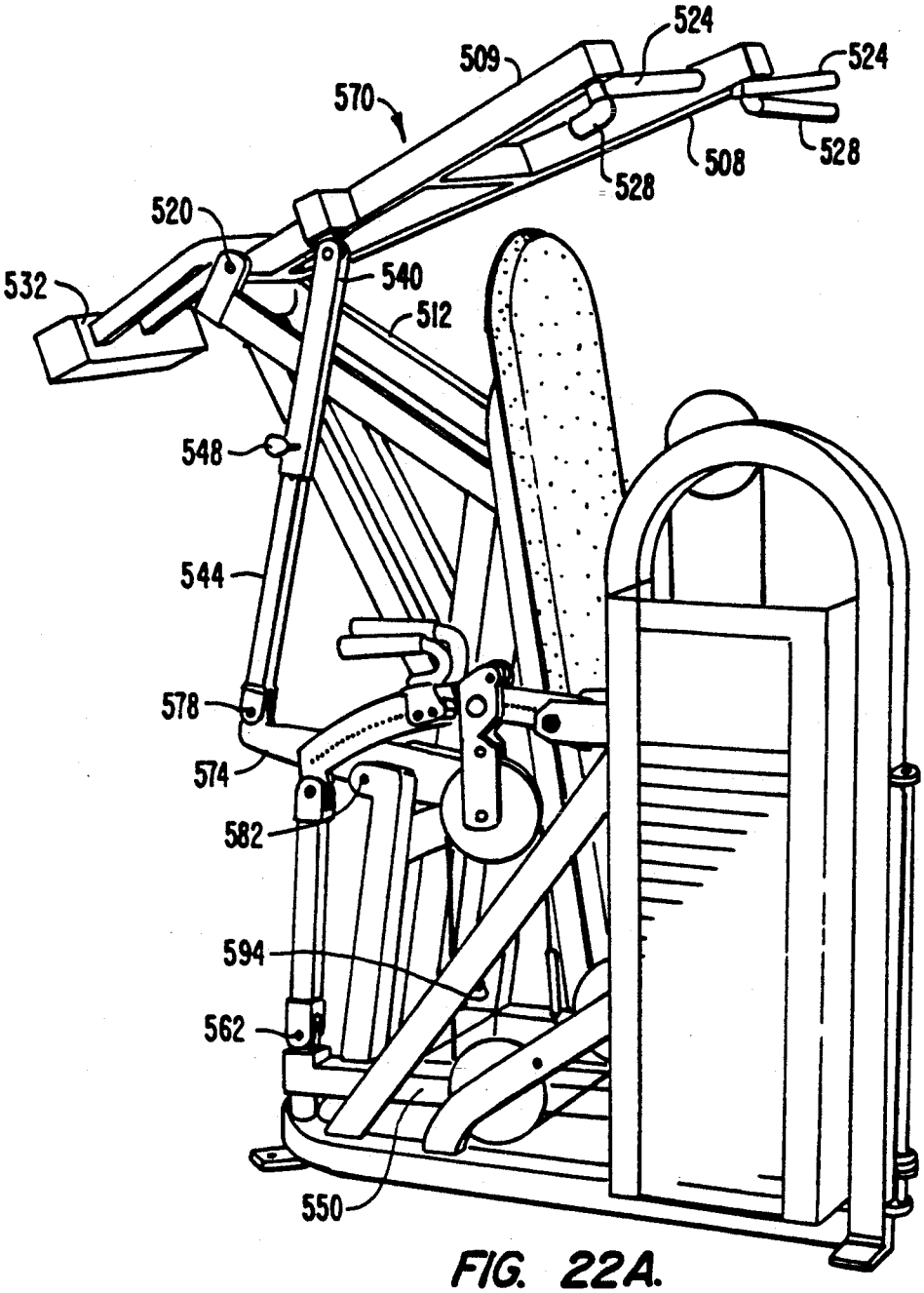
FIG. 22A is a left side view of a particular embodiment of a lat pulldown machine according to the present invention which incorporates the weight lifting machine shown in FIG. 1.
Figure 22D:
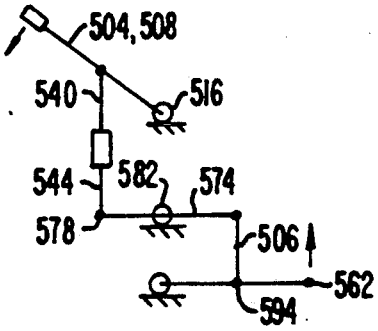
FIGS. 22D-E are schematic drawings of the lat pulldown machine in initial and pulled-down positions.
Figure 22E:
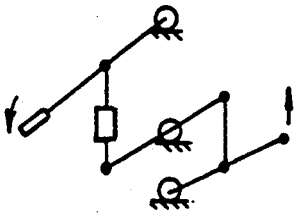
Figure 22B:
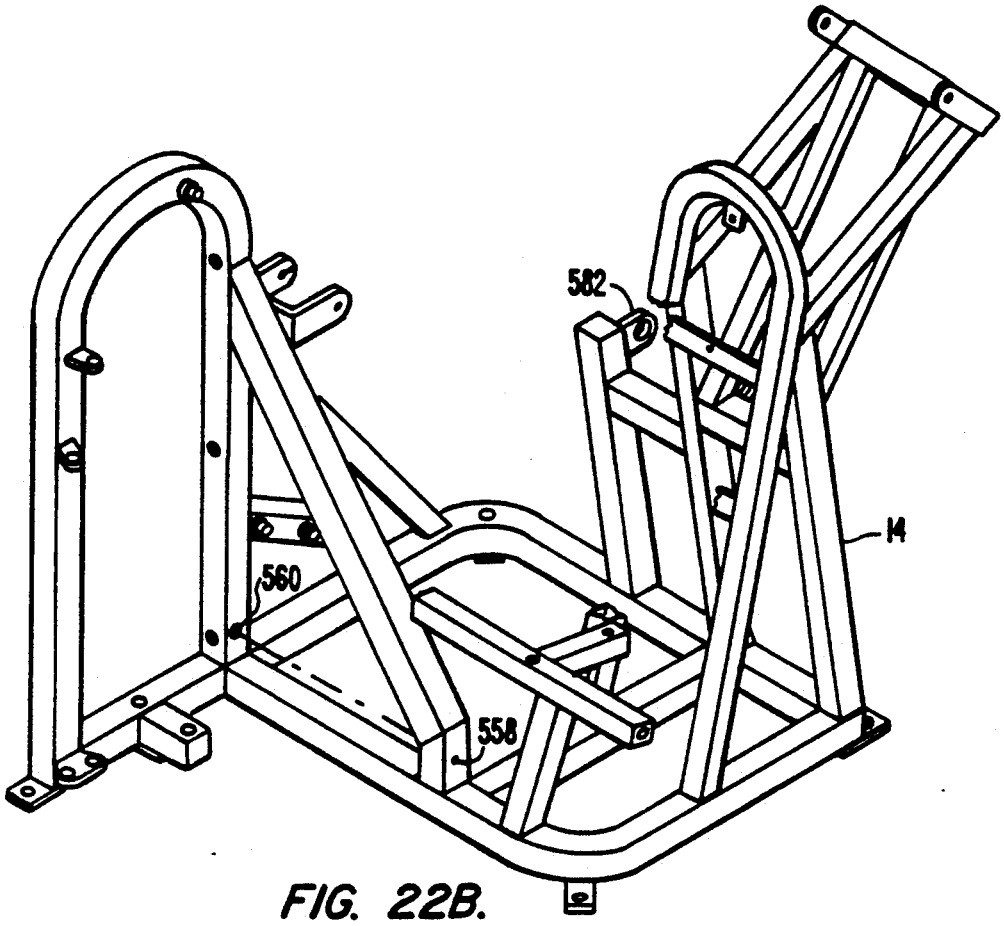
FIG. 22B is a perspective view of the frame for the lat pulldown machine shown in FIG. 22A.
Figure 22C:
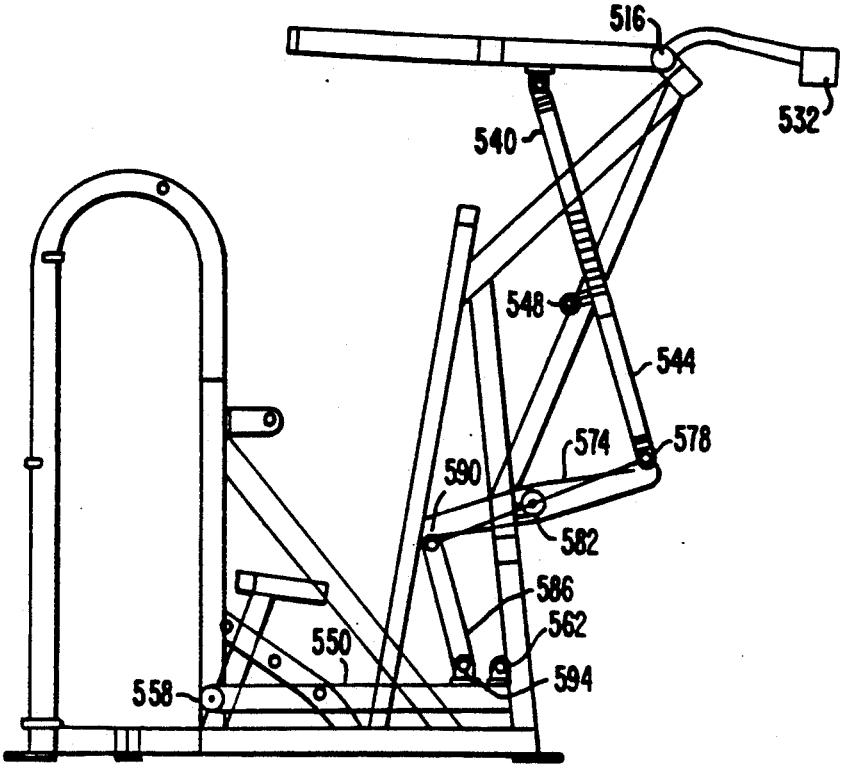
FIG. 22C is a side schematic view of the lat pulldown machine shown in FIG. 22A.

FIGS. 22A–C are views of a particular embodiment of a lat pulldown machine 570 according to the present invention which incorporates weight lifting machine 10 shown in FIG. 1. From inspection of these figures, it is readily apparent that lat pulldown machine 570 is constructed substantially the same way as shoulder press machine 500. Accordingly, the same components are numbered the same, and only a description of the differences will be provided here.

Unlike shoulder press machine 500, shaft 544 does not directly couple to truss 550. Instead, shaft 544 is pivotally coupled to one end of a motion reversal lever 574 by a coupling 578. A central portion of motion reversal lever 574 is pivotally coupled to frame 14 by a coupling 582. The other end of motion reversal lever 574 is coupled to a connecting rod 586 by a coupling 590, and connecting rod 586 is coupled to truss 550 by a coupling 594. Thus, all that is required to convert shoulder press machine 500 into lat pulldown machine 570 is to reverse the effect of movement of bars 504 and 508. Although motion reversal lever 574 has been used for this purpose in this embodiment, the same result could be achieved by coupling shaft 540 in shoulder press machine 500 to counterweight 532 or some other point in back of couplings 516 and 520.

FIGS. 22D–E are schematic drawings of lat pulldown machine 570 in initial and pulled down positions. Pulling down on bars 504 and 508 cause a corresponding upward lifting force at drive link 60.

CHEST PRESS MACHINE

FIGS. 23A–D are views of a particular embodiment of a chest press machine 600 according to the present invention which incorporates weight lifting machine 10 shown in FIG. 1. Chest press machine 600 includes push bars 604, 608 which are pivotally coupled to an overhead portion 612 of frame 14 by couplings 616 and 618. Each push bar 604, 608 includes a handle 620 for providing a neutral grip position and a handle 624 for providing a pronated grip position. Push bars 604, 608 are further coupled to a shaft 630 by a coupling 632 (FIG. 23C), and shaft 630 is pivotally coupled to a motion transmission bar 634 by a coupling 638. Motion transmission bar 634 is pivotally coupled to frame 14 by couplings 642 and 643, and it includes a curved portion 645 (FIG. 23D) which is coupled to a shaft 646 by a coupling 650. Shaft 646 telescopingly mates with another shaft 654 which, in turn, is pivotally coupled to a truss 658 by a coupling 662. A pin 666 associated with shaft 646 engages apertures (not shown) in shaft 654 for setting the desired initial position of push bars 604, 608 (and hence their range of motion). Truss 658 is pivotally coupled to frame 14 by couplings 670 and 672 and to drive link 50 by a coupling 674.

Figure 23A:
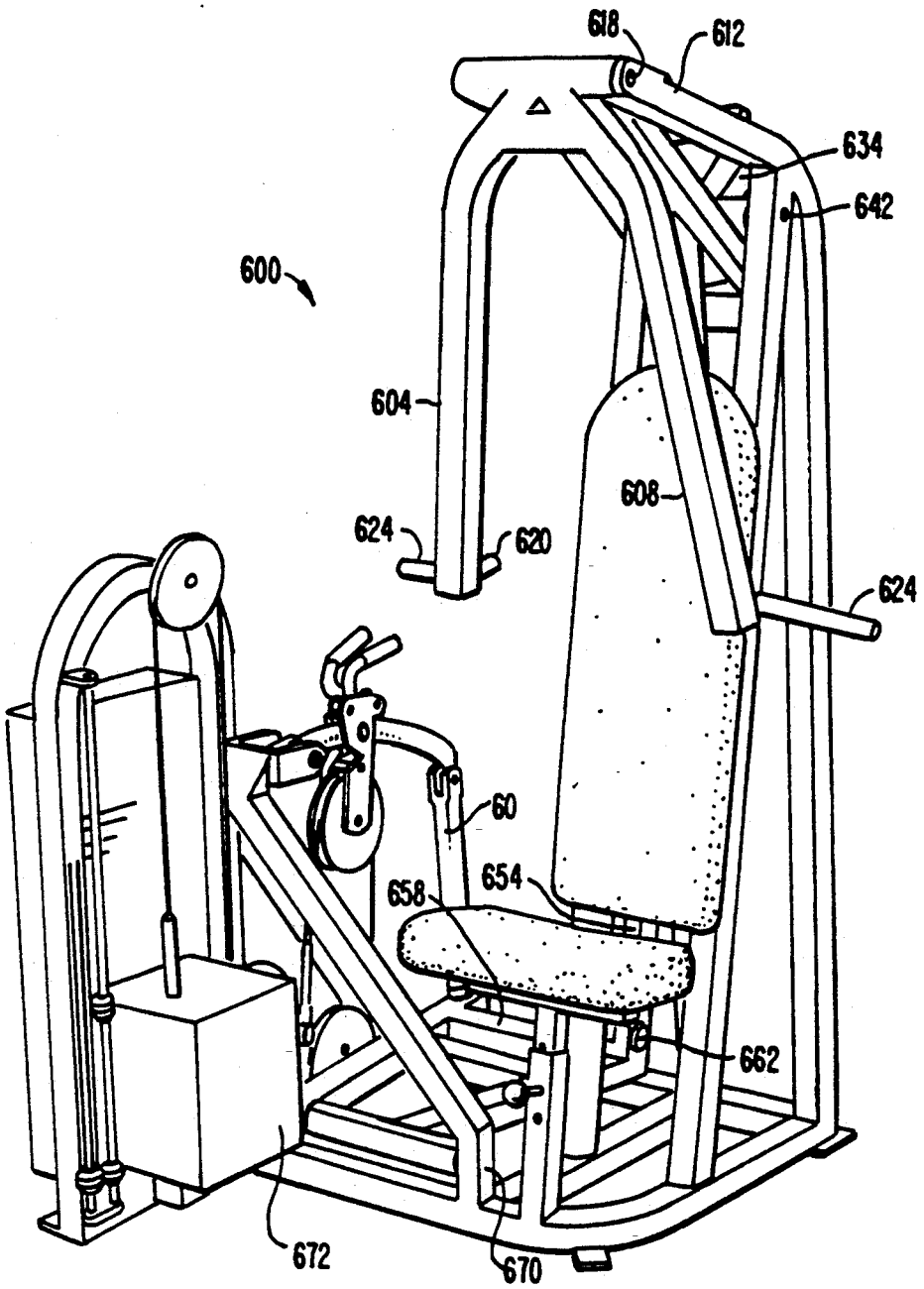
FIG. 23A is a right side view of a particular embodiment of a chest press machine according to the present invention which incorporates the weight lifting machine shown in FIG. 1.
Figure 23E:
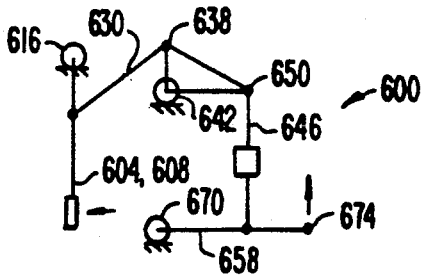
FIGS. 23E-F are schematic drawings of the chest press machine in initial and extended positions.
Figure 23F:
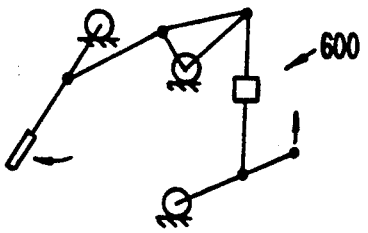
Figure 23B:
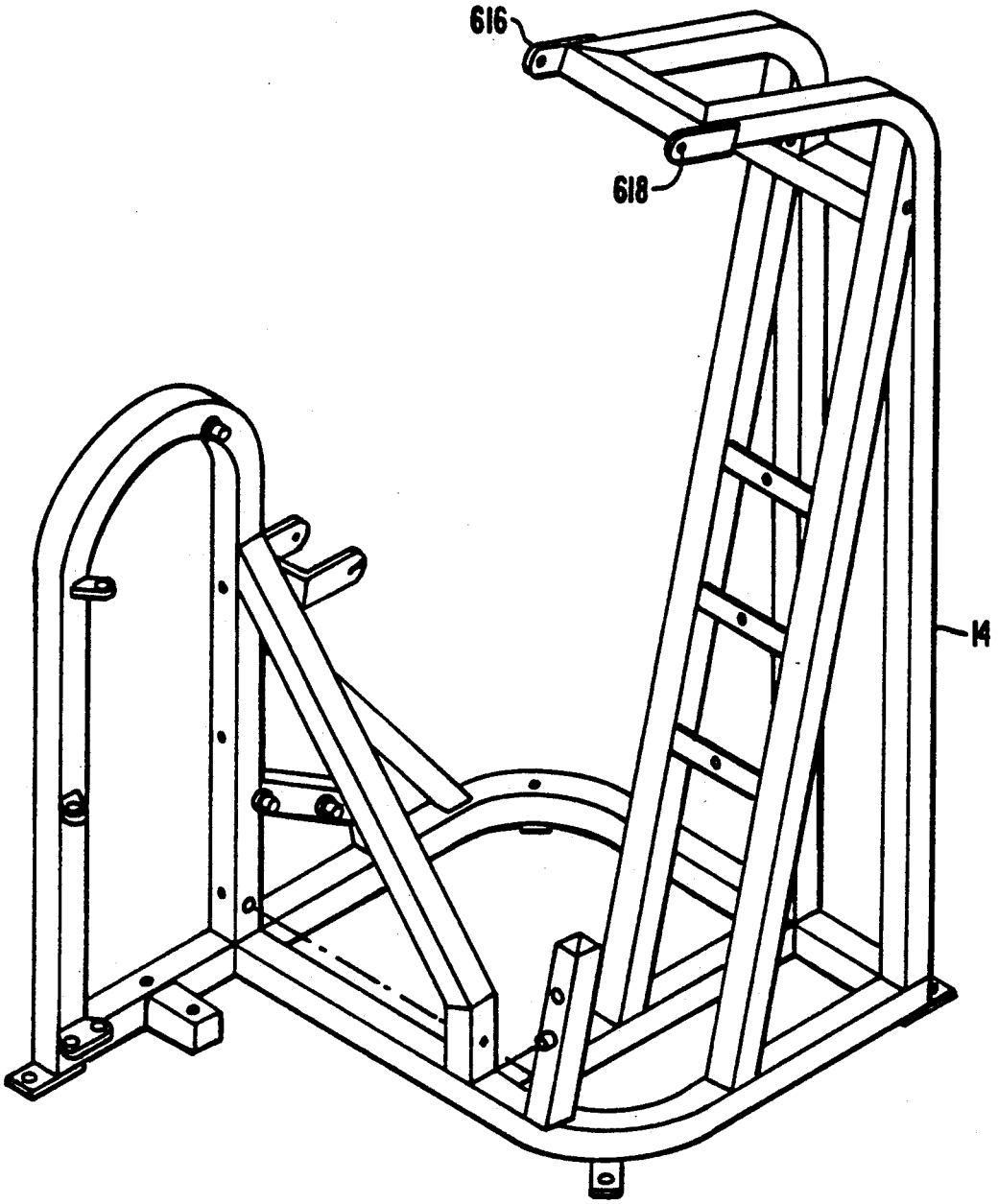
FIG. 23B is a perspective view of the frame for the chest press machine shown in FIG. 23A.
Figure 23C:
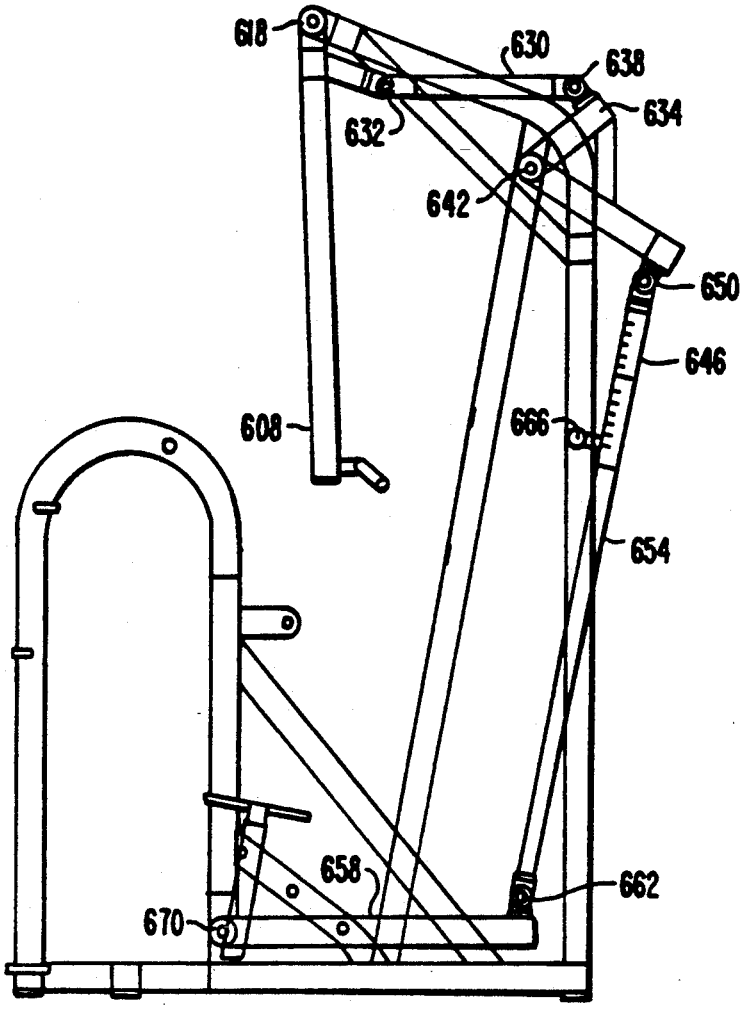
FIG. 23C is a side schematic view of the chest press machine shown in FIG. 23A.
Figure 23D:
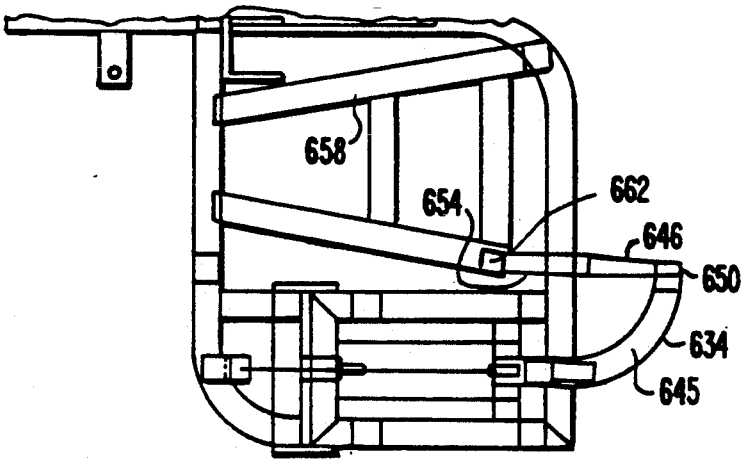
FIG. 23D is a top view of the chest press machine shown in FIG. 23A.

FIGS. 23E-F are schematic drawings of chest press machine 600 in initial and extended positions. It can be seen from these Figs. how forward movement of push bars 604, 608 cause truss 658 to pivot and create a corresponding upward force at drive link 60.

LEG CURL MACHINE

Figures 24A, 24B, 24C:
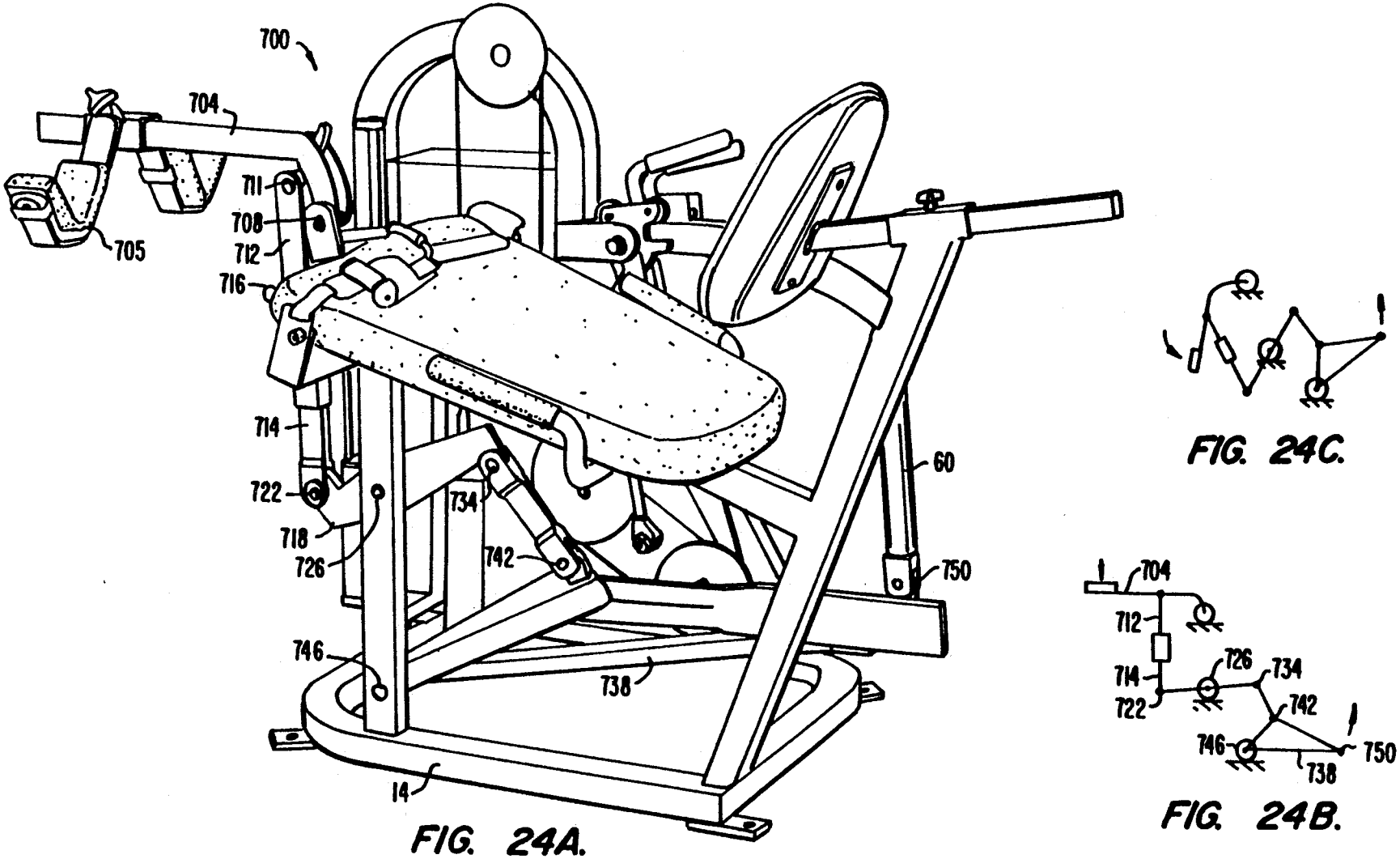
FIG. 24A is a right side view of a particular embodiment of a leg curl machine according to the present invention which incorporates the weight lifting machine shown in FIG. 1.
FIGS. 24B-C are schematic drawings of the leg curl machine in initial and pulled-down positions.

FIG. 24A is a perspective view of a particular embodiment of a leg curl machine 700 according to the present invention which incorporates weight lifting machine 10 shown in FIG. 1. From inspection of FIG. 24A it is apparent that leg curl machine 700 resembles leg extension machine 10 of FIG. 18B, except that it incorporates a motion reversal mechanism much like lat pulldown machine 570. Leg curl machine 700 includes a push bar 704 pivotally coupled to frame 14 by a coupling 708. Leg pads 705 are slidingly coupled to push bar 704 for contacting the back of a user's legs. Push bar 704 is further pivotally coupled by a coupling 711 to a shaft 712 which telescopingly mates with another shaft 714. A pin 716 associated with shaft 712 extends into one of a plurality of apertures (not shown) in shaft 714 for selecting the desired initial position of push bar 704 (and hence its range of motion). Shaft 714 is pivotally coupled to one end of a motion reversal lever 718 by a coupling 722. A center portion of motion reversal lever 718 is pivotally coupled to frame 14 by a coupling 726, and the other end of motion reversal lever 718 is pivotally coupled to a connecting rod 730 by a coupling 734. The other end of connecting rod 730 is pivotally coupled to a truss 738 by a coupling 742. Truss 738 is coupled to frame 14 by couplings 746 and 748 and to drive link 60 by a coupling 750.

FIGS. 24B-C are schematic drawings of leg curl machine 700 in initial and pushed down positions. It can be seen from these figures that force applied to push bar 704 causes truss 736 to pivot and create a corresponding upward force at drive link 60.

ROWING MACHINE

Figure 25D:
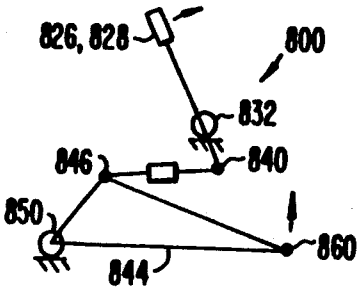
FIGS. 25D-E are schematic drawings of the rowing machine in initial and pulled-forward positions.
Figure 25E:
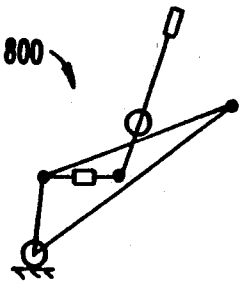
Figure 25A:
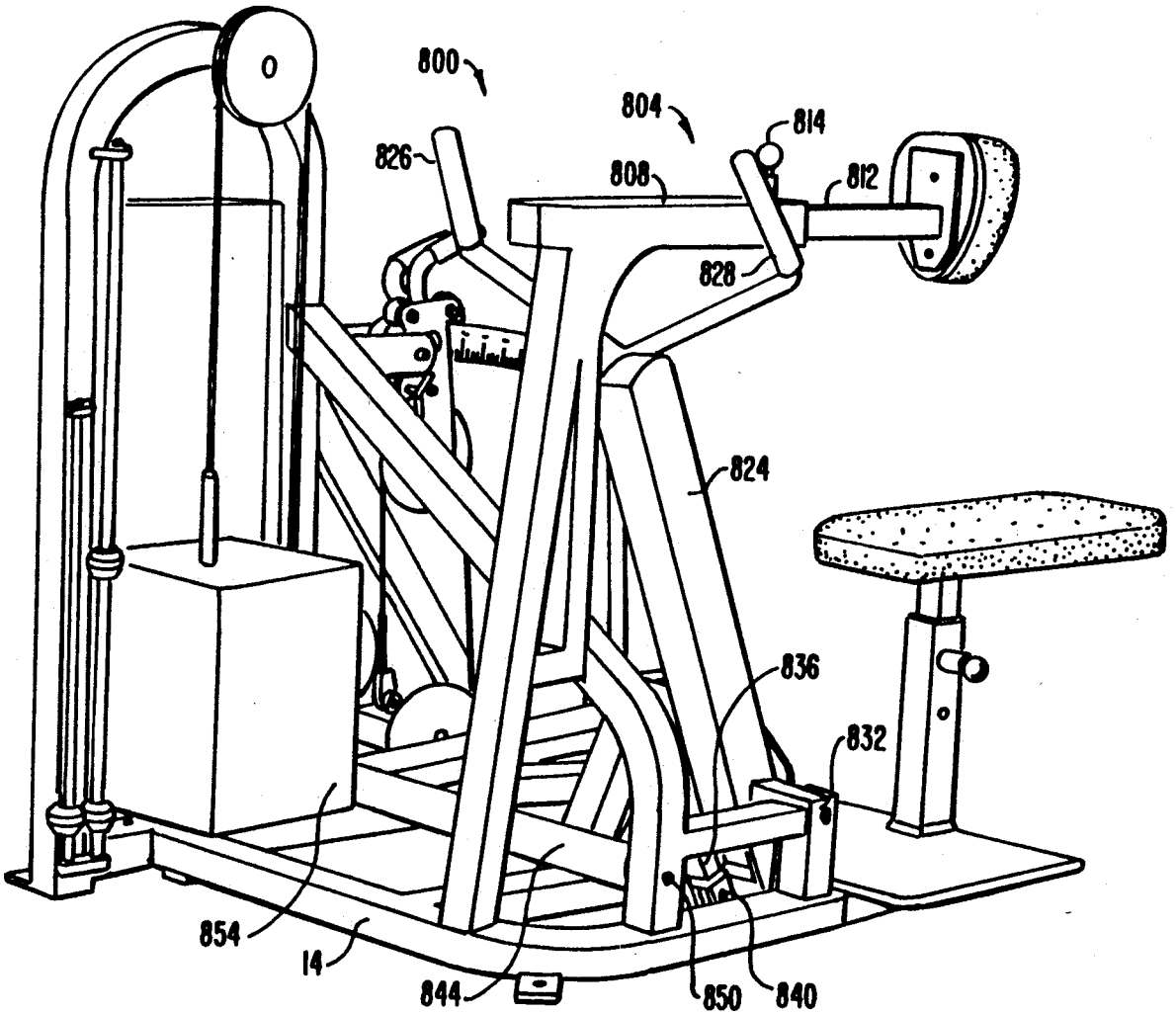
FIG. 25A is a right side view of a particular embodiment of a forward rowing machine according to the present invention which incorporates the weight lifting machine shown in FIG. 1.
Figure 25B:
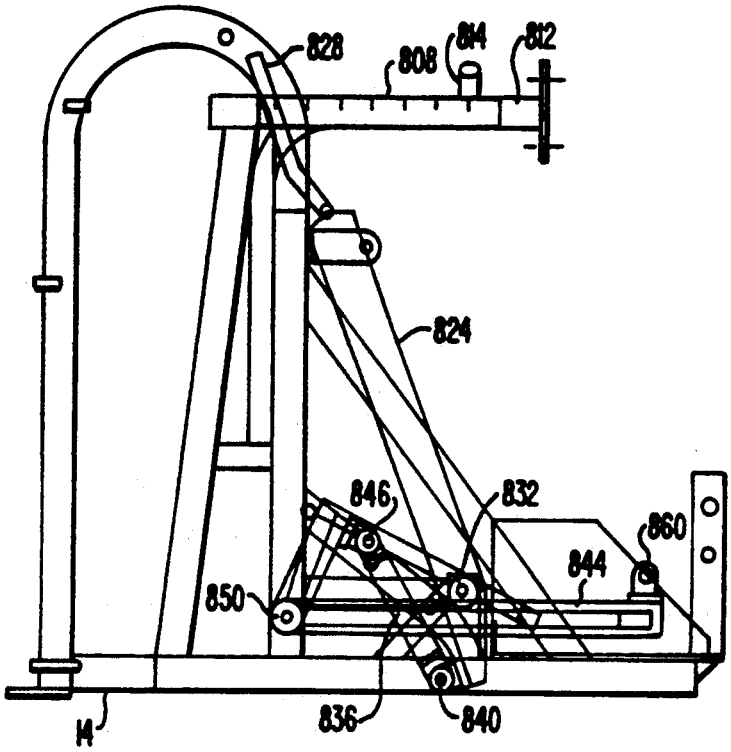
FIG. 25B is a side schematic view of the rowing machine shown in FIG. 25A.
Figure 25C:
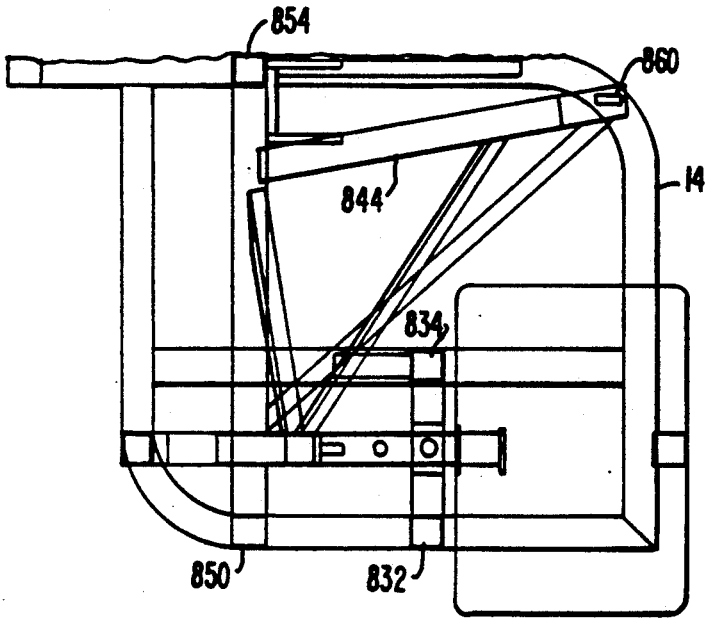
FIG. 25C is a top view of the rowing machine shown in FIG. 25B.

FIGS. 25A-C are views of a particular embodiment of a forward rowing machine 800 according to the present invention which incorporates weight lifting machine 10 shown in FIG. 1. In this embodiment, frame 14 includes a chest brace 804 comprising a shaft 808 which telescopingly mates with a shaft 812. A pin 814 associated with shaft 808 engages one of a plurality of apertures (not shown) in shaft 812 for positioning a chest pad 820. Rowing machine 800 further comprises a pull bar 824 having handles 826, 828 extending therefrom. Pull bar 824 is pivotally coupled to frame 14 by couplings 832 and 834. Pull bar 824 is further pivotally coupled to one end of a connecting rod 836 by a coupling 840. The other end of connecting rod 836 is pivotally coupled to a truss 844 by a coupling 846. Truss 844 is pivotally coupled to frame 14 by couplings 850 and 854 and to drive link 60 by a coupling 860.

FIGS. 25D-E are schematic diagrams showing rowing machine 800 in initial and pulled forward position. It is apparent that rowing machine 800 translates the motion of pull bar 824 into an upward force at drive link 60.

It should be apparent that weight machine 10 lends itself to many applications and modifications. Furthermore, the modular nature of the components and the concept of translating the user's motion to a location off to the side of the user has many advantages as well. For example, a traditional weight stack could be coupled to the machine so that the stack is next to the user, and the user need not get off the machine in order to adjust the pin which selects the number of weights to be lifted. Consequently, the scope of the invention should not be limited except as described in the claims.

What is claimed is:

1. An exercise and rehabilitation apparatus comprising:
   - a frame;
   - an elongated, arcuate, generally horizontal lever having first and second ends, the first end being pivotally coupled to the frame, and the second end being capable of moving in a radial direction;
   - a carriage disposed on the lever for movement between first and second ends of the lever;
   - wherein the carriage includes position fixing means for fixing the carriage at a selected location along the lever;
   - a first guide coupled to the carriage for movement therewith;
   - a second guide coupled to the frame below the lever;
   - a resistance element;
   - a third guide coupled to the frame above the second guide;
   - a belt having a first end coupled to the resistance element, the belt extending directly from the first guide to the second guide, the belt being disposed on the third guide so that the resistance element is suspended from the third guide, and the belt being disposed on the first guide so that radial movement of the lever causes the resistance element to move solely along a vertical axis a distance proportional to the location of the carriage along the lever.

2. The apparatus according to claim 1 wherein the resistance element comprises a weight which hangs freely from the third guide in an elevated position at all times so that the belt is under tension of the full force of the weight at all times.

3. The apparatus according to claim 1 further comprising an elongated generally vertical rigid drive link having a first end pivotally connected to the second end of the lever.

4. The apparatus according to claim 3 further comprising a rigid member for applying an upward compressive force on the drive link.

5. The apparatus according to claim 1 further comprising a permanent stop for continuously preventing the lever from pivoting downward from a generally horizontal position.

6. An exercise and rehabilitation apparatus comprising:
   - a frame;
   - a generally horizontal lever having first and second end sections, the first end section being pivotally coupled to the frame at a pivot point, and the second end section being capable of moving in a radial direction;
   - a carriage disposed on the lever for movement between first and second ends of the lever;

wherein the carriage includes position fixing means for fixing the carriage at a selected location along the lever;

a resistance element;

a first guide coupled to the carriage for movement therewith;

a second guide coupled to the frame;

a belt having a first end coupled to the resistance element, the belt being disposed on the second guide so that the resistance element is suspended from the second guide, and the belt being disposed on the first guide so that radial movement of the lever causes the resistance element to move a distance proportional to the location of the carriage along the lever relative to the pivot point;

wherein the first end of the lever extends beyond the pivot point so that the carriage may be located on either side of the pivot point;

wherein the resistance element moves in a first direction when the carriage is located on one side of the pivot point; and wherein the resistance element moves in a second direction opposite the first direction when the carriage is located on the other wise of the pivot point.

7. An exercise and rehabilitation apparatus comprising:

a frame;

a lever having first and second end sections, the first end section being pivotally coupled to the frame at a pivot point, and the second end section being capable of moving in a radial direction;

wherein the lever has a plurality of enclosed apertures disposed therein closely adjacent to each other;

a carriage disposed on the lever for movement between the first and second ends of the lever;

wherein the carriage includes a first pin and a second pin which are selectively extended into one of the apertures for fixing the carriage at a selected location along the lever;

wherein the carriage includes a handle coupled to the first pin so that the first pin may be selectively extended into and retracted from its associated aperture;

wherein the second pin is located relative to the first pin so that, when the first pin extends into one of the apertures, the second pin is disposed between adjacent apertures in a retracted position;

a resistance element;

a first guide coupled to the carriage for movement therewith;

a second guide coupled to the frame;

a belt having a first end coupled to the resistance element, the belt being disposed on the second guide so that the resistance element is suspended from the second guide, and the belt being disposed on the first guide so that radial movement of the lever causes the resistance element to move a distance proportional to the location of the carriage along the lever relative to the pivot point.

8. The apparatus according to claim 7 wherein the resistance element comprises a weight.

9. An exercise and rehabilitation apparatus comprising:

a frame;

a lever having first and second end sections, the first end section being pivotally coupled to the frame at a pivot point, and the second end section being capable of moving in a radial direction;

wherein the lever has a plurality of enclosed apertures disposed therein;

a carriage disposed on the lever for movement between first and second ends of the lever;

wherein the carriage includes a first pin which is selectively extended into one of the apertures for fixing the carriage at a selected location along the lever;

a resistance element;

a first guide coupled to the carriage for movement therewith;

a second guide coupled to the frame;

a belt having a first end coupled to the resistance element, the belt being disposed on the second guide so that the resistance element is suspended from the second guide, and the belt being disposed on the first guide so that radial movement of the lever causes the resistance element to move a distance proportional to the location of the carriage along the lever relative to the pivot point;

and wherein the first end of the lever extends beyond the pivot point so that the carriage may be located on either side of the pivot point.

10. An exercise and rehabilitation apparatus comprising:

a frame;

a lever having first and second end sections, the first end section being pivotally coupled to the frame, and the second end section being capable of moving in a radial direction;

wherein the lever has a plurality of enclosed apertures disposed therein;

a carriage disposed on the lever for movement between the first and second ends of the lever;

wherein the carriage includes a first pin which is selectively extended into one of the apertures for fixing the carriage at a selected location along the lever;

a resistance element;

a first guide coupled to the carriage for movement therewith;

a second guide coupled to the frame;

a belt having a first end coupled to the resistance element, the belt being disposed on the second guide so that the resistance element is suspended from the second guide, and the belt being disposed on the first guide so that radial movement of the lever causes the resistance element to move a distance proportional to the location of the carriage along the lever;

wherein the carriage further comprises:

a first handle;

a second handle; and pin control means, coupled to the first and second handles and to the first pin, for retracting the first pin from its associated aperture when the first and second handles are squeezed together and for extending the first pin into the aperture when the first and second handles are released.

11. The apparatus according to claim 10 wherein the plurality of apertures are located closely adjacent to each other, wherein the carriage includes a second pin located relative to the first pin so that, when the first pin extends into one of the apertures, the second pin is disposed between adjacent apertures in a retracted position, and wherein the pin control means causes both the first and second pins to be in a retracted position when the handles are squeezed together.

12. An exercise and rehabilitation apparatus comprising:

a frame;

a lever having first and second end sections, the first end section being pivotally coupled to the frame, and the second end section being capable of moving in a radial direction;

a carriage disposed on the lever for movement between first and second ends of the lever;

wherein the carriage includes position fixing means for fixing the carriage at a selected location along the lever;

a weight;

a first guide coupled to the carriage for movement therewith;

a second guide coupled to the frame;

a belt having a first end coupled to the weight, the belt being disposed on the second guide so that the weight is suspended from the second guide, and the belt being disposed on the first guide so that radial movement of the lever causes the weight to move a distance proportional to the location of the carriage along the lever;

a user interface for contacting a part of a body of a user, the user interface including an interface member disposed in and moving in a first vertical plane;

a rigid member, coupled to the user interface, for translating movement in the first vertical plane to movement in a second vertical plane parallel to the first vertical plane;

rigid member coupling means, disposed in the second plane, for coupling the second end section of the lever to the rigid member so that the lever moves in response to movement of the user interface; and wherein the rigid member coupling means couples the second end section of the lever to the rigid member so that the rigid member applies a compressive force for moving the lever in response to movement of the user interface.

13. The apparatus according to claim 12 wherein the lever is disposed in and moves in the second plane.

14. An exercise and rehabilitation apparatus comprising:

a frame;

a lever having first and second end sections, the first end section being pivotally coupled to the frame at a pivot point, and the second end section being capable of moving in a radial direction;

a carriage disposed on the lever for movement between first and second ends of the lever;

wherein the carriage includes position fixing means for fixing the carriage at a selected location along the lever;

a weight;

a first guide coupled to the carriage for movement therewith;

a second guide coupled to the frame;

a belt having a first end coupled to the weight, the belt being disposed on the second guide so that the weight is suspended from the second guide, and the belt being disposed on the first guide so that radial movement of the lever causes the weight to move a distance proportional to the location of the carriage along the lever;

a user interface for contacting a part of a body of a user, the user interface being capable of moving in a first vertical plane;

a rigid member, coupled to the user interface, for translating movement in the first plane to movement in a second plane;

rigid member coupling means, disposed in the second plane, for coupling the second end section of the lever to the rigid member so that the lever moves in response to movement of the user interface; and and wherein the first end of the lever extends beyond the pivot point so that the carriage may be located on either side of the pivot point.

15. An exercise and rehabilitation apparatus comprising:

a frame;

a lever having first and second ends, the first end being pivotally coupled to the frame, and the second end being capable of moving in a radial direction;

a carriage disposed on the lever for movement between the first and second ends of the lever;

wherein the carriage includes position fixing means for fixing the carriage at a selected location along the lever;

a weight;

a first guide coupled to the frame;

a belt having a first end coupled to the weight and a second end coupled to the carriage, the belt being disposed on the guide so that the weight is suspended from the guide, and the belt being coupled to the carriage so that radial movement of the lever causes the weight to move in a vertical plane for a distance proportional to the location of the carriage along the lever;

a user interface for contacting a part of a body of a user; and a rigid member coupled to the user interface and the second end of the lever for applying a compressive force to the second end of the lever in response to movement of the user interface.

16. An exercise and rehabilitation apparatus comprising:

a frame;

a generally horizontal lever having first and second ends, the first end being pivotally coupled to the frame, and the second end being capable of moving in a radial direction;

a carriage disposed on the lever for movement between the first and second ends of the lever;

wherein the carriage includes position fixing means for fixing the carriage at a selected location along the lever;

a weight;

a first guide coupled to the carriage for movement therewith;

a second guide coupled to the frame;

a belt having a first end coupled to the weight, the belt being disposed on the second guide so that the weight is suspended from the second guide, and the belt being disposed on the first guide so that radial movement of the lever causes the weight to move a distance proportional to the location of the carriage along the lever;

a drive link having first and second ends, the first end of the drive link being pivotally coupled to the second end of the lever;

a rigid member having first and second ends, the first end of the rigid member being pivotally coupled to the second end of the drive link for applying a compressive force thereto, and the second end of the rigid member being pivotally coupled to the frame;

wherein the lever, the drive link, the rigid member and the frame form a four-bar linkage which constrains the path that the lever, the drive link and the rigid member move relative to each other.

17. The apparatus according to claim 16 further comprising:

user interface means, pivotally coupled to the rigid member, for contacting a part of a body of a user; and wherein movement of the part of the body of the user causes radial movement of the second end of the lever.

18. An exercise and rehabilitation apparatus comprising:

a frame;

a lever having first and second ends, the first end being pivotally coupled to the frame at a first point, and the second end being capable of moving in a radial direction;

a carriage disposed on the lever for movement between the first and second ends of the lever;

wherein the carriage includes position fixing means for fixing the carriage at a selected location along the lever;

a weight;

a first guide coupled to the carriage for movement therewith;

a second guide coupled to an upper part of the frame;

a third guide coupled to a lower part of the frame;

a belt having a first end coupled to the weight, the belt being disposed on the second guide so that the weight is suspended from the second guide, the belt being under tension of the full force of the weight, the belt being disposed on the first guide so that radial movement of the lever causes the weight to move a distance proportional to the location of the carriage along the lever, and the belt extending directly from the first guide to the third guide; and wherein the lever is shaped and the third guide is located so that the weight remains stationary when the carriage is moved along the lever when the lever is in an initial position.

19. The apparatus according to claim 18 wherein the lever is formed as a circular arc having a constant radius of curvature.

20. An exercise and rehabilitation apparatus comprising: a frame;

an elongated, arcuate, generally horizontal lever having first and second end sections, the first end section being pivotally coupled to the frame, and the second end section being capable of moving in a radial direction;

a carriage disposed on the lever for movement between first and second ends of the lever;

wherein the carriage includes position fixing means for fixing the carriage at a selected location along the lever;

a first pulley;

an elongated pulley coupling member having a first end pivotally coupled to the carriage;

wherein the first pulley is rotatably coupled to a second end of the pulley coupling member below the carriage;

a second pulley coupled to the frame below the first pulley;

a third pulley coupled to the frame above the second pulley;

a weight;

a belt having a first end coupled to the weight and a second end coupled to the frame;

wherein the belt extends directly from the frame to the first pulley and passes around the first pulley;

wherein the belt extends directly from the first pulley to the second pulley and passes around the second pulley;

wherein the belt extends directly from the second pulley to the third pulley and passes around the third pulley;

wherein the belt is disposed on the third pulley so that the weight is suspended from the third pulley, the belt being under tension of the full force of the weight at all times; and wherein radial movement of the lever causes the weight to move a distance proportional to the location of the carriage along the lever.

* * * * *